US007052338B2

(12) United States Patent
Morvillo

(10) Patent No.: US 7,052,338 B2
(45) Date of Patent: May 30, 2006

(54) INTEGRAL REVERSING AND TRIM DEFLECTOR AND CONTROL MECHANISM

(76) Inventor: Robert A. Morvillo, 79 Massasoit St., Waltham, MA (US) 02454

( * ) Notice: Subject to any disclaimer, the term of this patent is extended or adjusted under 35 U.S.C. 154(b) by 110 days.

(21) Appl. No.: 10/213,829

(22) Filed: Aug. 6, 2002

(65) Prior Publication Data

US 2003/0054707 A1 Mar. 20, 2003

Related U.S. Application Data

(60) Provisional application No. 60/310,554, filed on Aug. 6, 2001.

(51) Int. Cl.
*B63H 11/11* (2006.01)

(52) U.S. Cl. ..... 440/41

(58) Field of Classification Search ..... 440/38, 440/40, 41, 42, 43; 60/221, 222; 114/145 R
See application file for complete search history.

(56) References Cited

U.S. PATENT DOCUMENTS

| | | | | |
|---|---|---|---|---|
| 3,258,916 | A * | 7/1966 | Lehmann | 239/265.25 |
| 3,756,185 | A | 9/1973 | Breslin | |
| 4,538,997 | A | 9/1985 | Haglund | |
| 4,992,065 | A | 2/1991 | Törneman et al. | |
| 5,031,561 | A | 7/1991 | Nilsson | |
| 5,421,753 | A | 6/1995 | Roos | |
| 5,579,711 | A | 12/1996 | Thomas | |
| 5,664,978 | A | 9/1997 | Howe | |
| 5,713,770 | A | 2/1998 | Ambli | |
| 5,934,954 | A * | 8/1999 | Schott et al. | 440/41 |
| 6,193,571 | B1 | 2/2001 | Burg | |
| 6,234,100 | B1 | 5/2001 | Fadeley et al. | |
| 6,234,853 | B1 | 5/2001 | Lanyi et al. | |
| 6,238,257 | B1 * | 5/2001 | Platzer et al. | 440/42 |
| 6,652,333 | B1 * | 11/2003 | Adomeit | 440/43 |

FOREIGN PATENT DOCUMENTS

| | | | | |
|---|---|---|---|---|
| DE | 3700-530 A * | 7/1988 | | 440/41 |
| DE | 4033674 A1 | 7/1991 | | |
| EP | 0035859 A2 | 9/1981 | | |
| EP | 0035859 A3 | 9/1981 | | |
| EP | 0778196 A1 | 6/1997 | | |
| EP | 0778196 B1 | 4/2002 | | |
| JP | 3-587 A * | 1/1991 | | 440/41 |
| WO | WO 01/34463 A2 | 5/2001 | | |
| WO | WO 01/34463 A3 | 5/2001 | | |

* cited by examiner

*Primary Examiner*—Andrew D. Wright
(74) *Attorney, Agent, or Firm*—Lowrie, Lando & Anastasi, LLP

(57) ABSTRACT

A thrust control system is described, including a control apparatus having water jet deflectors that deflect water to provide a reversing/backing thrust and a trim force to marine vessels using water jet propulsion. Other aspects include an electro-mechanical control lever assembly for operating actuators, the assembly comprising a mechanical lever coupled to a transducer that generates an electrical output. Yet other aspects comprise a load-sensing hydraulic circuit comprising at least two loads and a control system for controlling at least one of the loads, that prevents unwanted pressure transients in the circuit.

25 Claims, 19 Drawing Sheets

INTEGRAL REVERSING AND TRIM DEFLECTOR AND CONTROL MECHANISM

RELATED APPLICATIONS

The present application claims priority, under 35 U.S.C. §119(e), to U.S. provisional patent application, Ser. No. 60/310,554, entitled "Integral Reversing and Trim Deflector," which was filed on Aug. 6, 2001, and which is hereby incorporated by reference.

TECHNICAL FIELD

The present invention relates to marine vessel propulsion and control systems. More particularly, aspects of the invention relate to devices for controlling thrust in marine vessels and to systems for controlling these devices. Aspects of the invention may be used in other filed employing electromechanical or hydraulic control systems.

BACKGROUND

Marine vessels have a wide variety uses for transportation of people and cargo across bodies of water. These uses include fishing, military and recreational activities. Marine vessels may move on the water surface as surface ships do, as well as move beneath the water surface, as submarines do. Some marine vessels use propulsion and control systems.

Various forms of propulsion have been used to propel marine vessels over or through the water. One type of propulsion system comprises a prime mover, such as an engine or a turbine, which converts energy into a rotation that is transferred to one or more propellers having blades in contact with the surrounding water. The rotational energy in a propeller is transferred by contoured surfaces of the propeller blades into a force or "thrust" which propels the marine vessel. As the propeller blades push water in one direction, thrust and vessel motion are generated in the opposite direction. Many shapes and geometries for propeller-type propulsion systems are known.

Other marine vessel propulsion systems utilize water jet propulsion to achieve similar results. Such devices include a pump, a water intake or suction port and an exit or discharge port, which generate a water jet stream that propels the marine vessel. The water jet stream may be deflected using a "deflector" to provide marine vessel control by redirecting some water jet stream thrust in a suitable direction and in a suitable amount.

In some applications, such as in ferries, military water craft, and leisure craft, it has been found that propulsion using water jets is especially useful. In some instances, water jet propulsion can provide a high degree of maneuverability when used in conjunction with marine vessel controls that are specially-designed for use with water jet propulsion systems.

It is sometimes more convenient and efficient to construct a marine vessel propulsion system such that the net thrust generated by the propulsion system is always in the forward direction. The "forward" direction, or "ahead" direction is along a vector pointing from the stern, or aft end of the vessel, to its bow, or front end of the vessel. By contrast, the "reverse", "astern" or "backing" directing is along a vector pointing in the opposite direction (or 180° away) from the forward direction. The axis defined by a straight line connecting a vessel's bow to its stem is referred to herein as the "major axis" of the vessel. A vessel has only one major axis. Any axis perpendicular to the major axis is referred to herein as a "minor axis." A vessel has a plurality of minor axes, lying in a plane perpendicular to the major axis. Some marine vessels have propulsion systems which primarily provide thrust only along the vessel's major axis, in the forward or backward directions. Other thrust directions, along the minor axes, are generated with awkward or inefficient auxiliary control surfaces, rudders, planes, deflectors, etc. Rather than reversing the direction of a ship's propeller or water jet streams, it may be advantageous to have the propulsion system remain engaged in the forward direction while providing other mechanisms for redirecting the water flow to provide the desired maneuvers.

One example of a device that redirects or deflects a water jet stream is a conventional "reversing bucket," found on many water jet propulsion marine vessels. A reversing bucket deflects water, and is hence also referred to herein as a "reversing deflector." The reversing deflector generally comprises a deflector that is contoured to at least partially reverse a component of the flow direction of the water jet stream from its original direction to an opposite direction. The reversing deflector is selectively placed in the water jet stream (sometimes in only a portion of the water jet stream) and acts to generate a backing thrust, or force in the backing direction.

A reversing deflector may thus be partially deployed, placing it only partially in the water jet stream, to generate a variable amount of backing thrust. By so controlling the reversing deflector and the water jet stream, an operator of a marine vessel may control the forward and backwards direction and speed of the vessel.

A requirement for safe and useful operation of marine vessels is the ability to steer the vessel from side to side. Some systems, commonly used with propeller-driven vessels, employ "rudders" for this purpose. A rudder is generally a planar water deflector or control surface, placed vertically into the water, and parallel to a direction of motion, such that left-to-right deflection of the rudder, and a corresponding deflection of a flow of water over the rudder, provides steering for the marine vessel.

Other systems for steering marine vessels, commonly used in water jet stream propelled vessels, rotate the exit or discharge nozzle of the water jet stream from one side to another. Such a nozzle is sometimes referred to as a "steering nozzle." Hydraulic actuators may be used to rotate an articulated steering nozzle so that the aft end of the marine vessel experiences a sideways thrust in addition to any forward or backing force of the water jet stream. The reaction of the marine vessel to the side-to-side movement of the steering nozzle will be in accordance with the laws of motion and conservation of momentum principles, and will depend on the dynamics of the marine vessel design.

Despite the proliferation of the above-mentioned systems, some maneuvers remain difficult to perform in a marine vessel. These include "trimming" the vessel, docking and other maneuvers in which vertical and lateral forces are provided.

It should be understood that while particular control surfaces are primarily designed to provide force or motion in a particular direction, these surfaces often also provide forces in other directions as well. For example, a reversing deflector, which is primarily intended to develop thrust in the backing direction, generally develops some component of thrust or force in another direction such as along a minor axis of the vessel. One reason for this, in the case of reversing deflectors, is that, to completely reverse the flow of water from the water jet stream, (i.e., reversing the water jet stream by 180°) would generally send the deflected water towards the aft surface of the vessel's hull, sometimes known as the transom. If this were to happen, little or no backing thrust would be developed, as the intended thrust in the backing direction developed by the reversing deflector would be counteracted by a corresponding forward thrust resulting from the collision of the deflected water with the rear of the vessel or its transom. Hence, reversing deflectors often redirect the water jet stream in a direction that is at an angle which allows for development of backing thrust, but at the same time flows around or beneath the hull of the marine vessel. In fact, sometimes it is possible that a reversing deflector delivers the deflected water stream in a direction which is greater than 45° (but less than 90°) from the forward direction.

Nonetheless, those skilled in the art appreciate that certain control surfaces and control and steering devices such as reversing deflectors have a primary purpose to develop force or thrust along a particular axis. In the case of a reversing deflector, it is the backing direction in which thrust is desired.

Similarly, a rudder is intended to develop force primarily in a side-to-side or athwart ships direction, even if collateral forces are developed in other directions. Thus, net force should be viewed as a vector sum process, where net or resultant force is generally the goal, and other smaller components thereof may be generated in other directions at the same time.

One particular aspect of marine vessel control which is lacking in some water jet propulsion systems is the availability to provide adequate trim or trimming force. "Trimming" force is a force that is substantially along the vertical axis of the vessel. This force acts to raise or lower the marine vessel, or parts thereof, along a vertical axis. Upwards trim force is developed by deflecting water from a water jet stream in a downward direction, and conversely, downward trim is developed by deflecting at least a portion of the water jet stream upwards. The various directions and axes described herein will be illustrated in more detail in the Detailed Description section below.

Steering and trimming control surfaces generally do not develop any backing thrust. Steering and trimming surfaces, such as rudders, trim tabs and interceptors provide forces along minor axes of a marine vessel and generally do not redirect any appreciable portion of a water jet stream in a direction less than 90° from the forward direction. Thus, these trimming and steering surfaces do not develop any significant backing thrust. Accordingly, steering and trimming control surfaces should not be confused with a reversing deflector, as reversing deflectors do provide a deflection of a water jet stream with enough forward deflection (having a component traveling in a direction less than 90° from the forward direction) to provide backing thrust.

In some cases it is advantageous to provide trim forces, especially at or near the aft end of a surface vessel, to achieve more efficient motion through the water. Some vessels, such as high-speed military and leisure craft, benefit from being able to ride "up on plane" with the trim of the vessel set at an angle to minimize resistance. The vessel may be made to rest or travel with varying inclination of its major axis. That is, the vessel's bow may be raised with respect to its stern.

Another reason that makes it desirable to be able to provide trim forces is to provide "active ride control." By active ride control it is meant the ability to deliver varying amounts of trimming force to counter external variable forces on the marine vessel and make the vessel travel smoothly through the water. Passenger vessels, e.g., ferries, can benefit from a system that is able to counter excessive rocking and pitching due to rough seas. Control surfaces that can provide trimming forces could be used to counteract, pitch, roll and heave in real time to provide a more comfortable ride for a ship's occupants and cargo.

Furthermore, there is a need for control devices which can accurately control such trim deflectors and other control apparatus in marine vessels and other hydraulic control systems. Most conventional marine vessel control systems comprise purely mechanical devices, which convert some input from a marine vessel operator into a force or a deflection motion of a control surface. For example, when the vessel operator moves a control lever handle, the control lever handle typically either directly moves a rudder through a linkage, or controls a position of a hydraulic valve which then causes the control surface to move due to hydraulic fluid pressure on an actuator of the control surface.

Hydraulic power assistance for actuating the steering nozzles and reversing deflectors is especially useful or necessary for large vessels at high speeds where large forces are needed to resist the water forces and mechanical forces acting on the control surfaces.

Some marine vessel control systems that use hydraulic fluid pressure to actuate various actuators of the control systems suffer from weaknesses that reduce the effectiveness of these control systems. This can jeopardize the safety of the marine vessel and its operators. For example, many current hydraulic control systems experience high-pressure transients which propagate through the hydraulic system and affect the operation and safety of the system in an undesirable way. These transients, sometimes known as "kickback", are a result of fluid trapped in hydraulic components following a hard-steering evolution. Hydraulic fluid-high pressure transients can also adversely affect the longevity of the components within the system, as well as cause hazards to the operators of the system, to the marine vessel and to its cargo.

SUMMARY

Accordingly, there is a need for a device for developing controllable trimming forces in a marine vessel using water jet propulsion. Also there is a need for a control device to control thrust or propulsion forces in marine vessels using water jet propulsion, as well as a need for control devices that address the propagating pressure transients in hydraulic systems for controlling marine vessels.

In one aspect of the invention, to provide a trim thrust, e.g., in a downward direction, a "trim deflector" is coupled to a reversing deflector, and is controllably placed at an angle with respect to the water jet stream to provide such trim thrust to the marine vessel. When attached to or coupled to the reversing deflector, said trim deflector can be moved in unison along with the reversing deflector, e.g., by rotation about a common pivot. In this way, it is possible to alternately provide trim or backing thrust, depending on whether the reversing deflector or the trim deflector is placed in the water jet stream.

Some embodiments of an integral reversing and trim deflector device fixably attach the trim deflector to the reversing deflector, while others couple the trim deflector to the reversing deflector, but allow the trim deflector to have a variable angle and orientation with respect to the reversing deflector. The adjustable trim deflector can provide variable amounts of trim thrust and apply said trim thrust in variable controllable directions about the main propulsion thrust direction.

The present invention also addresses improvements and solutions to existing deficiencies in control systems, such as hydraulic and electro-hydraulic control systems, of the kind which may be used in marine vessels or other vessels employing control surfaces or devices actuated by hydraulic actuators. Some aspects of the present invention prevent steering wheel kickback in vehicles and vessels using hydraulic controls and prevent or reduce the propagation of pressure transients in such control systems. Also, other aspects of the present invention provide improved control devices such as control levers and allow for conversion of mechanical control input signals to corresponding electrical control signals.

One embodiment of the present invention is directed to an integral marine vessel reversing and trim deflector apparatus, comprising a first deflector, having a degree of freedom allowing said first deflector to be moved into a water jet stream to deflect a first portion of a water jet stream so as to provide a thrust, a component of said thrust being directed in a backing direction; and a second deflector, coupled to said first deflector and moving in unison with said first deflector, such that the second deflector can be moved into said water jet stream so as to deflect a second portion of said water jet stream thereby providing a force, a component of said force being directed in a trim direction, wherein said force has substantially no component in said backing direction.

Another embodiment is directed to a device for controlling thrust in a marine vessel, comprising a deflector apparatus having at least two deflector surfaces: a first deflector surface that deflects a first portion of a water jet stream to provide a backing thrust when the deflector apparatus is in a first position; and a second deflector surface that deflects a second portion of a water jet stream to provide a trim force when the deflector apparatus is in a second position; wherein said deflector apparatus is configured so that it cannot be in both said first and said second positions simultaneously.

Yet another embodiment is directed to a method for generating a backing thrust and a trim force for use in a marine vessel control apparatus, comprising providing a first deflector that in a first position deflects a first portion of a water jet stream in a first direction to provide said backing thrust; and providing a second deflector, coupled to said first deflector and moving in unison with said first deflector, that in a second position deflects a second portion of said water jet stream in a second direction to provide said trim force; wherein providing said first deflector and said second deflector comprise providing the deflectors so that said backing thrust and said trim force are provided substantially perpendicular to one another.

One other embodiment is directed to a method for providing a reversing and trimming deflector apparatus, comprising providing a reversing deflector arranged to rotate about a common axis; coupling a trim deflector to the reversing deflector such that the trim deflector and the reversing deflector rotate in unison about said common axis so that each of said reversing deflector and trim deflector deflects a water jet stream substantially exclusively of the other, thereby providing a respective backing thrust and trimming force.

Still another embodiment is directed to a trim deflector apparatus, comprising a first deflector surface that has a first degree of freedom such as to provide a first trimming force that includes substantially no backing component; and a second deflector surface that has a second degree of freedom such as to provide a second trimming force that includes substantially no backing component; wherein said first and second deflectors can also be moved into respective cooperating positions such that they cooperatively provide a thrust having a backing component.

Another embodiment of the invention is directed to an electro-mechanical control apparatus for controlling a parameter of a marine vessel propulsion system, comprising a control lever handle having a first degree of freedom corresponding to a value of said parameter; a connecting device, having at least two degrees of freedom, coupled to said control lever handle, and that moves in response to movement of said control lever handle, wherein said connecting device is articulated to provide conversion of motion from the first degree of freedom to motion in the second degree of freedom; and an electro-mechanical transducer, coupled to said connecting device, that provides an electrical output signal corresponding to a position of said connecting device; wherein said electrical output signal corresponds to the value of said parameter.

Yet another embodiment is directed to a method for converting a marine vessel mechanical control lever assembly into an electro-mechanical control lever assembly, comprising providing an electro-mechanical transducer adapted for converting a position of a connecting device to an electrical output signal; coupling a control lever handle and said electro-mechanical transducer via said connecting device, wherein said coupling comprises transferring a first motion in a first degree of freedom into a corresponding second motion in a second degree of freedom; and measuring a movement of said control lever handle with said electro-mechanical transducer and providing a corresponding electrical control signal.

Another embodiment is directed to a load-sensing hydraulic circuit that reduces pressure transients in marine vessel control systems, comprising a hydraulic pressure source that provides a hydraulic system pressure and that provides a flow of hydraulic fluid; a first hydraulic load actuator, receiving a first portion of said hydraulic fluid; a control apparatus, coupled to said first hydraulic load actuator, that controls said hydraulic load actuator; a second hydraulic load actuator, receiving a second portion of said hydraulic fluid and affecting a hydraulic load pressure; a multi-port hydraulic valve, having a first port coupled to a high pressure side of said hydraulic pressure source, a second port coupled to said second hydraulic load actuator, and a third port coupled to said control apparatus; and a check valve, disposed between said third port and said control apparatus, that allows flow of said hydraulic fluid from said third port to said control apparatus.

A method according to one embodiment of the invention is directed to reducing pressure transients from a first control device in a load-sensing marine vessel control system, comprising providing a supply of pressurized hydraulic fluid to a first hydraulic load actuator and to a hydraulic control circuit; sensing a maximum load pressure from the first hydraulic load actuator with a load-sensing network; controlling the at least one hydraulic load actuator with a control apparatus; and blocking a hydraulic pressure transient from travelling from said control apparatus to the hydraulic circuit.

DETAILED DESCRIPTION

In view of the above discussion, and in view of other considerations relating to design and operation of marine vessels, it is desirable to have a marine vessel control system which can provide forces in a plurality of directions, such as trimming force, and which can control said thrust in a safe and efficient manner. Some aspects of the present invention generate or transfer force from a water jet stream, initially flowing in a first direction, into one or more alternate directions. Other aspects provide controls for such systems.

Figure 1:
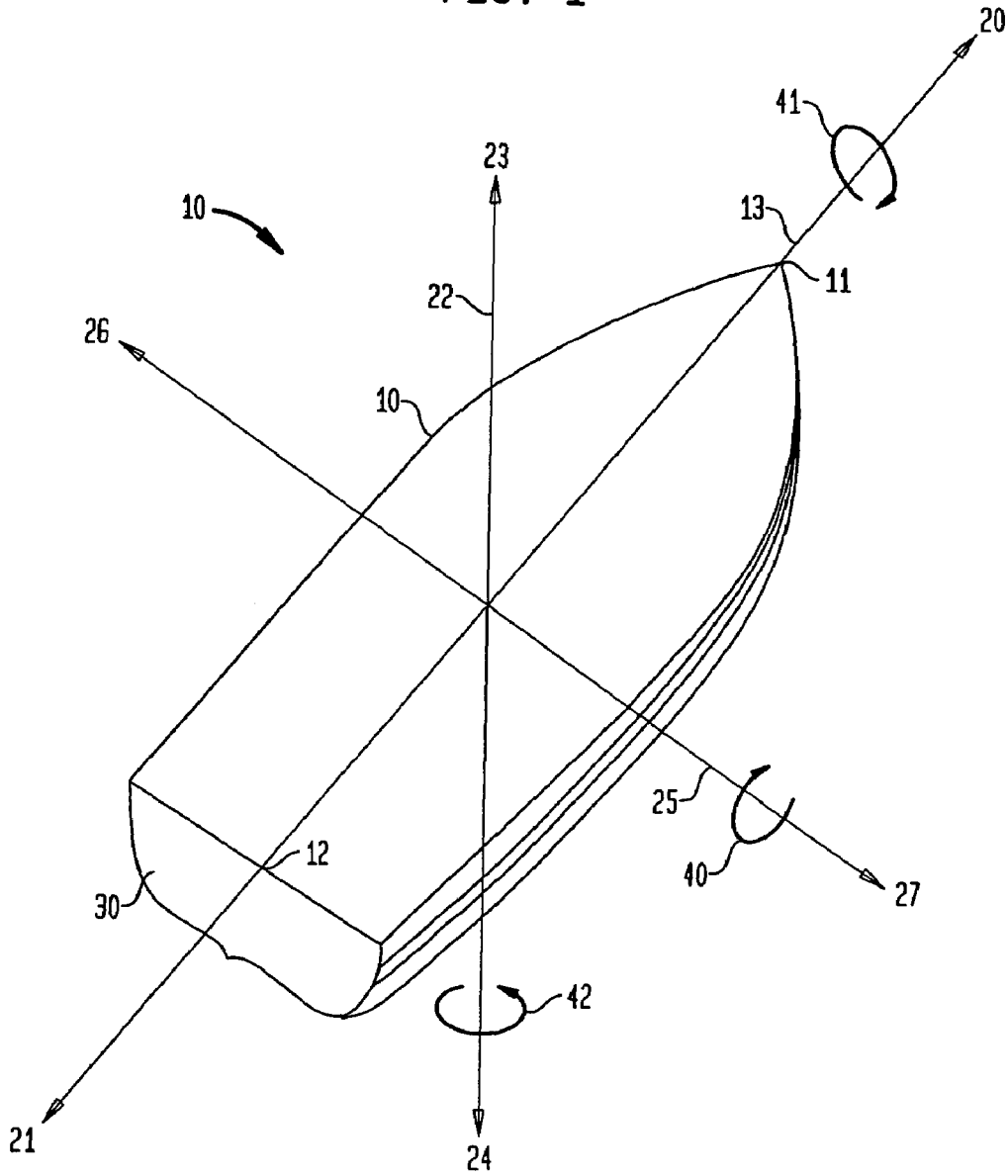
FIG. 1 illustrates a simplified perspective view of a marine vessel along with illustrative axes and directions referenced to the marine vessel.

Prior to a detailed discussion of various embodiments of the present invention, it is useful to define certain terms that describe the geometry of a marine vessel and associated propulsion and control systems. FIG. 1 illustrates an exemplary outline of a marine vessel 10 having a forward end called a bow 11 and an aft end called a stern 12. A line connecting the bow 11 and the stern 12 defines an axis hereinafter referred to the marine vessel's major axis 13. A vector along the major axis 13 pointing along a direction from stern 12 to bow 11 is said to be pointing in the ahead or forward direction 20. A vector along the major axis 13 pointing in the opposite direction (180° away) from the ahead direction 20 is said to be pointing in the astern or reverse or backing direction 21. Forces developed in the ahead and a stern directions are referred to as thrust.

The axis perpendicular to the marine vessel's major axis 13 and nominally perpendicular to the surface of the water on which the marine vessel rests, is referred to herein as the vertical axis 22. The vector along the vertical axis 22 pointing away from the water and towards the sky defines an up direction 23, while the oppositely-directed vector along the vertical axis 22 pointing from the sky towards the water defines the down direction 24. It is to be appreciated that the axes and directions, e.g. the vertical axis 22 and the up and down directions 23 and 24, described herein are referenced to the marine vessel 10. In operation, the vessel 10 experiences motion relative to the water in which it travels. However, the present axes and directions are not intended to be referenced to Earth or the water surface.

The axis perpendicular to both the marine vessel's major axis 13 and a vertical axis 22 is referred to as an athwartships axis 25. The direction pointing to the left of the marine vessel with respect to the ahead direction is referred to as the port direction 26, while the opposite direction, pointing to the right of the vessel with respect to the forward direction 20 is referred to as the starboard direction 27. The athwartships axis 25 is also sometimes referred to as defining a "side-to-side" force, motion, or displacement. Note that the athwartships axis 25 and the vertical axis 22 are not unique, and that many axes parallel to said athwartships axis 22 and vertical axis 25 can be defined.

With this the three most commonly-referenced axes of a marine vessel have been defined. The marine vessel 10 may be moved forward or backwards along the major axes 13 in directions 20 and 21, respectively. This motion is usually a primary translational motion achieved by use of the vessels propulsion systems when traversing the water as described earlier. Other motions are possible, either by use of vessel control systems or due to external forces such as surface waves on the water. Rotational motion of the marine vessel 10 about the athwartships axis 25 which alternately raises and lowers the bow 11 and stern 12 is referred to as pitch 40 of the vessel. Rotation of the marine vessel 10 about its major axis 13, alternately raising and lowering the port and starboard sides of the vessel is referred to as roll 41. Finally, rotation of the marine vessel 10 about the vertical axis 22 is referred to as yaw 42. An overall vertical displacement of the entire vessel 10 to that moves the vessel up and down (e.g. due to waves) is called heave.

In water jet propelled marine vessels a water jet is typically discharged from the aft end of the vessel in the astern direction 21. The marine vessel 10 normally has a substantially planar bulkhead or portion of the hull at its aft end referred to as the vessel's transom 30. In some small craft an outboard propeller engine is mounted to the transom 30.

Figure 2:
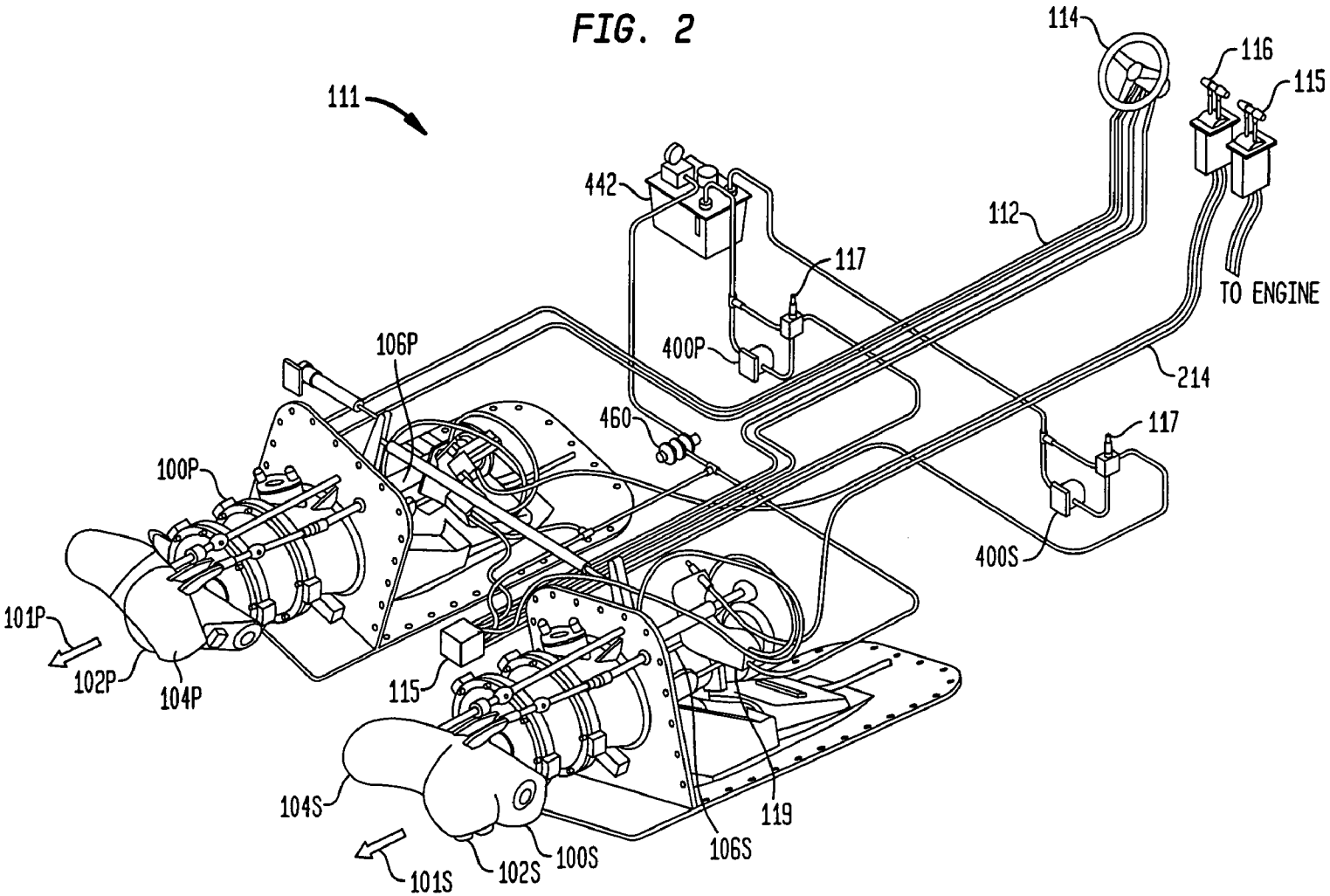
FIG. 2 illustrates a port and starboard water jet propulsion apparatus, and a mechanical control system for controlling a reversing deflector on each apparatus.

Referring to FIG. 2, a water jet propulsion system and controls therefor are illustrated. The figure illustrates a twin jet propulsion system 111, having port and starboard pumps 100P and 100S that generate respective water jet streams, and jet control apparatus. Both the port and starboard devices operate similarly, and will be considered analogous in the following discussions. Pumps 100P and 100S drive water jet streams 101P and 101S from an intake port to steering nozzles 102P and 102S. The figure also illustrates reversing deflectors 104P and 104S that are moved by control actuators 106P and 106S. The control actuators 106P and 106S comprise hydraulic piston cylinder arrangements for pulling and pushing the reversing deflectors 104P and 104S into and out of the water jet streams 101P and 101S.

The overall control system comprises a hydraulic circuit that includes a hydraulic power unit having hydraulic pump 400P and 400S that act as hydraulic pressure sources. The pumps 400P and 400S may be a fixed displacement pump, e.g., an axial piston pump, a gear pump, or a valve pump. The hydraulic power unit also includes a reservoir tank 442 that collects and stores hydraulic fluid at low pressure, as well as filters, cooler 460, sensors, valves 117 and other hydraulic plant auxiliaries.

Hydraulic fluid lines 112 connect various parts of the hydraulic circuit to one another. A marine vessel operator operates the hydraulically-actuated controls with mechanical control devices such as a helm (steering) wheel 114 and a mechanical control lever 116 that controls the reversing deflectors 104P and 104S. A second mechanical control lever 115 may also control the propulsion system, e.g. pumps 100P and 100S by controlling engine RPM.

Figure 3:
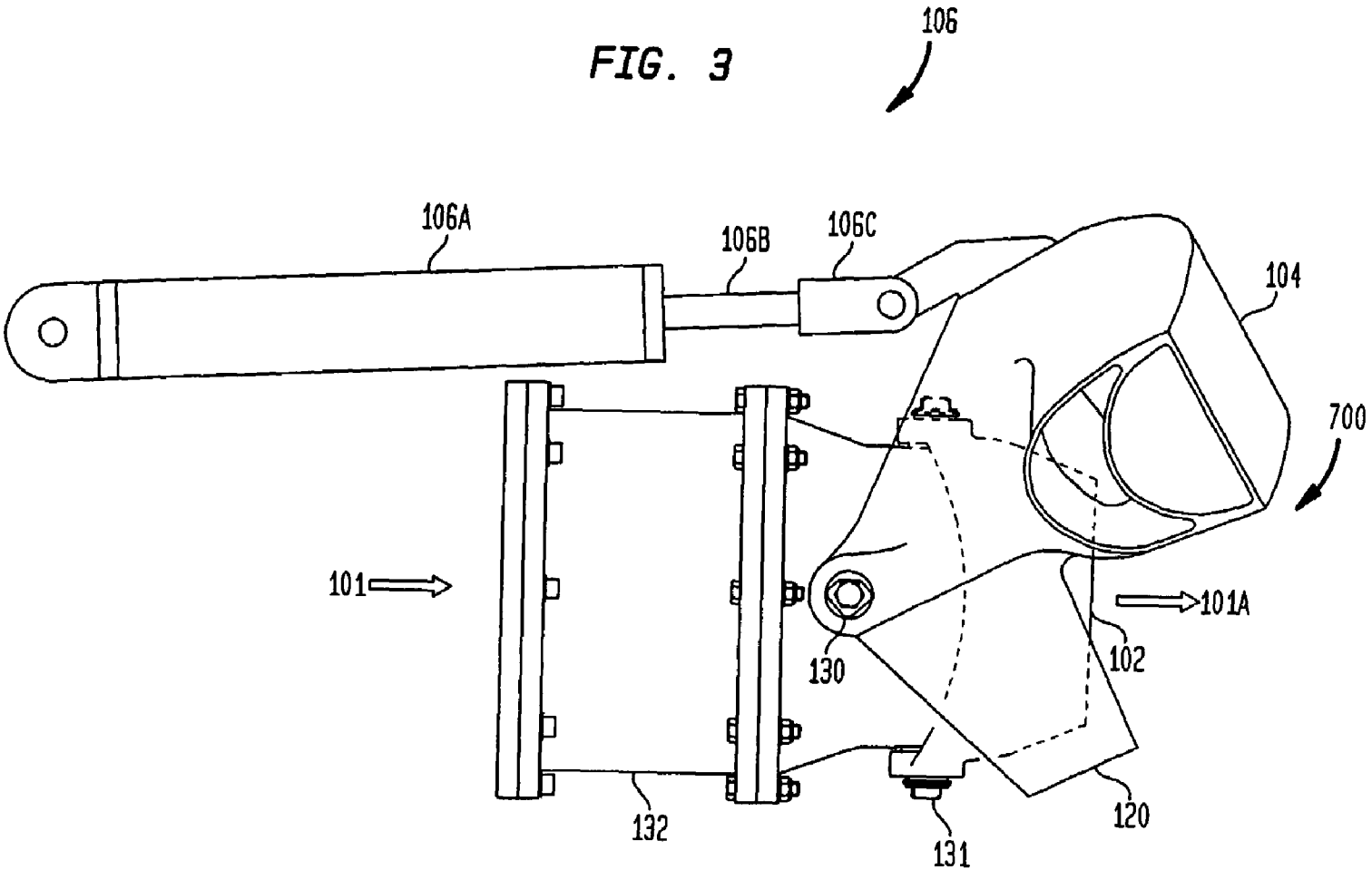
FIG. 3 illustrates one embodiment of an integral reversing deflector and trim deflector apparatus according to the present invention.
Figure 4A:
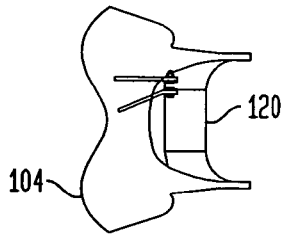
FIGS. 4*a*–4*e* illustrates several views of an apparatus according to one embodiment of the present invention.
Figure 4B:
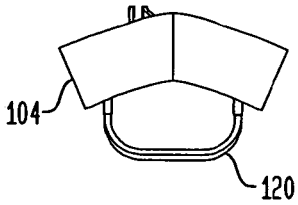
Figure 4C:
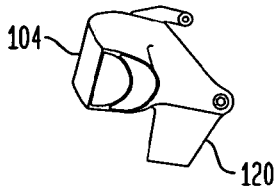
Figure 4D:
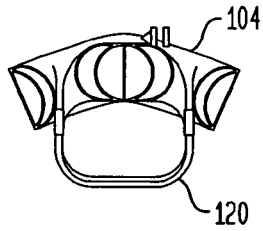
Figure 4E:
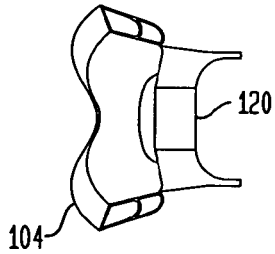

FIG. 3 illustrates an embodiment of an integral reversing deflector and trim deflector apparatus 700 according to an embodiment of the invention. A water jet propulsion system moves a water jet stream 101 pumped by a pump through water jet housing 132 and out the aft end of the propulsion system through the steering nozzle 102. The fact that the steering nozzle 102 is articulated to move side-to-side will be explained below, but this nozzle 102 may also be fixed or have another configuration. The water jet stream exiting the steering nozzle 102 is designated as 101A. The figure shows the reversing deflector 104 and trim deflector 120 positioned to allow the water jet stream to flow freely from 101 to 101A, thus providing forward thrust for the marine vessel. The forward thrust results from the flow of the water in a direction substantially opposite to the direction of the water jet stream. Trim deflector 120 is fixably attached to reversing deflector 104 in this embodiment, and both the reversing deflector 104 and the trim deflector 120 rotate in unison about a pivot 130. The apparatus for moving the integral reversing deflector and trim deflector comprises a hydraulic actuator 106, comprising a hydraulic cylinder 106A in which travels a piston and a shaft 106B attached to a pivoting clevis 106C. Shaft 106B slides in and out of cylinder 106A, causing a corresponding raising or lowering of the integral reversing deflector and trim deflector apparatus 700, respectively.

Figure 5A:
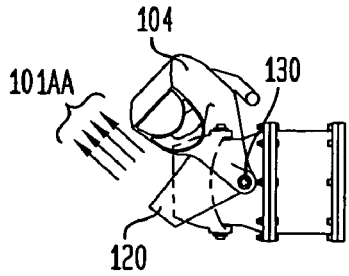
FIGS. 5*a*–5*d* illustrates shows several exemplary modes of operation of an integral reversing deflector and trim deflector apparatus given in FIGS. 4*a*–4*e;*
Figure 5B:
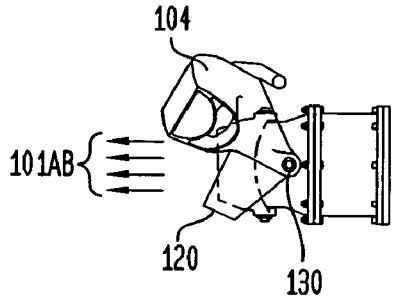
Figure 5C:
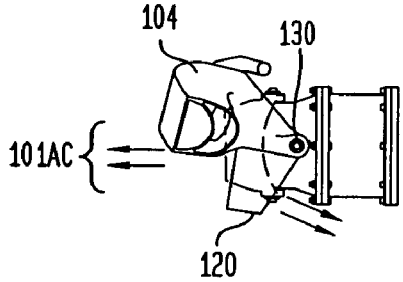
Figure 5D:
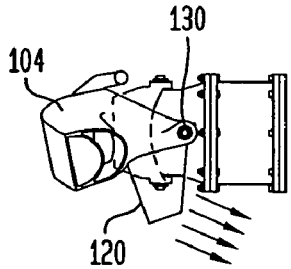

It can be seen from FIG. 3 (and FIGS. 5*c*–5*d*) that lowering the reversing deflector will provide progressively more backing thrust, until the reversing deflector is fully placed in the exit stream 101A, and full reversing or backing thrust is developed (see FIG. 5*d*). In this position, trim deflector 120 is lowered below and out of the exit stream 101A, and provides no trimming force.

Similarly, if the combined reversing deflector and trim deflector apparatus 700 is rotated upwards about pivot 130 (counter clockwise in FIG. 3) then the trim deflector 120 will progressively enter the exiting water stream 101A, progressively providing more trimming force (see FIG. 5*a*). In such a configuration, the reversing deflector 104 will be raised above and out of water jet exit stream 101A, and reversing deflector 104 will provide no force. The arrangement, geometry, angle of attachment and size of the reversing deflector 104 and the trim deflector 120 will in part determine the direction and magnitude of the resulting forces developed as these deflectors enter and exit the water jet stream 101A. In this embodiment, the reversing deflector 104 and the trim deflector 120 enter the water jet stream 101A in a mutually-exclusive way. That is, when one is in the water jet stream 101A, the other is moved out of the water jet stream 101A.

However, it is to be appreciated that various modifications to the arrangement, shape and geometry, the angle of attachment of the reversing deflector 104 and the trim deflector 120 and the size of the reversing deflector 104 and trim deflector 120 are possible. It is to be appreciated that although such arrangement and design is not expressly described herein for all embodiments, such modifications are nonetheless intended to be within the scope and description of this disclosure.

It is to be appreciated that, in some embodiments, the generation of backing thrust and/or trimming force can occur simultaneously with and independent of steering. That is, the vessel can turned and trimmed at the same time.

While FIG. 3 shows the trim deflector 120 as fixably attached to the reversing deflector 104, as an integrally-formed device, many other configurations and embodiments are possible. For example, the trim deflector 120 may be attached to the reversing deflector 104 using a weld joint which permanently attaches the two structures, also the trim deflector may be attached to the reversing deflector 104 with fasteners, e.g., nuts and bolts or rivets. In addition, although FIG. 3 illustrates the reversing deflector 104 and the trim deflector 120 as attached, the trim deflector 120 may be configured such as to be moveable with respect to the reversing deflector 104, as will be described below. Additionally, the reversing deflector 104 and the trim deflector 120 may be formed as a single part, e.g. by molding or casting the single part at the time of manufacture.

Steering nozzle 102 is illustrated in FIG. 3 to be capable of pivoting about a trunion or a set of pivots 131, optionally by actuating using a hydraulic actuator. Steering nozzle 102 may be articulated in such a manner as to provide side-to-side force by rotating the steering nozzle 102, thereby developing the corresponding sideways force that steers the marine vessel. This mechanism works even when the reversing deflector 104 is fully deployed, as more or less flow will travel through the port or starboard sides of the reversing deflector 104.

FIGS. 4*a*–4*e* illustrate several views of the integral reversing deflector and trim deflector apparatus, illustrated in FIG. 3. It can be seen from the various views of this embodiment that the trim deflector 120 can be a substantially-planar surface connected to the reversing deflector 104 in the shape of a "U." Using this description, the ends of the "U" are attached to reversing deflector 104 and the bottom part of the "U" provides the trimming force.

Several modes of operation of the integral reversing deflector and trim deflector are possible. The modes of operation primarily depend on the positioning of the integral deflecting apparatus with respect to the water jet stream exiting the steering nozzle 102. In FIG. 5 some exemplary modes of operation are illustrated. Other modes of operation will become apparent to those skilled in the art. For example, intermediate modes, providing finer control, which lie between those modes illustrated in FIG. 5 are possible using intermediate positioning of the deflector apparatus. As an illustration, a trim mode is shown in FIG. 5*a*, in which the trim deflector 120 is substantially completely within the exit of the water jet stream. In this position, downward force of the marine vessel is generated because the trim deflector 120 deflects the exiting water jet stream 101AA upwards, which results in a corresponding downward force.

A neutral mode is also illustrated in FIG. 5*c*, in which the reversing deflector 104 is partially placed in the exiting water jet stream 101AB, thus providing some backing thrust which is sufficient to counter the forward thrust generated by the exiting water jet stream.

In this mode, the trim deflector 120 is positioned out of the water jet stream 101AC and the component of thrust generated by the reversing deflector 104 offsets the component of thrust not deflected by the reversing deflector 104. It is to be appreciated that the backing thrust and/or the trim force also may lie in a plane perpendicular to the major axis of the marine vessel (see FIG. 1). That is, neither the reversing deflector 104 nor the trim deflector 120 are constrained or limited to providing thrust or force exclusively in a backing or in a trimming direction, respectively. Rather, depending on the positioning of the overall deflector apparatus, vector components of thrust are generated by each surface, and the marine vessel reacts according to the overall force balances exerted by its propulsion and control systems. Generally, the reversing deflector 104 will generate thrust in a backing direction, or thrust having its largest component along the backing direction of the marine vessels major axis (see FIG. 1). Similarly, the trim deflector 120 is generally designed and operated to provide the majority of its thrust contribution in a direction along one of the marine vessel's minor axes.

FIG. 5*b* illustrates the full ahead mode discussed earlier, where no reversing deflector or trim deflector surfaces impede the flow of the water jet stream. Also, a full reverse mode is illustrated in FIG. 5*d*, in which the reversing deflector 104 is placed substantially in the path of the exiting water jet stream.

As mentioned previously, many different configurations, geometries and modifications of the trim deflector 120 and of the integral reversing deflector and trim deflector apparatus 700 are possible. It should be appreciated that the integral reversing and trim deflector apparatus 700, shape, geometry and size can be modified depending on the particular application in which the apparatus 700 will be used.

Figure 6A:
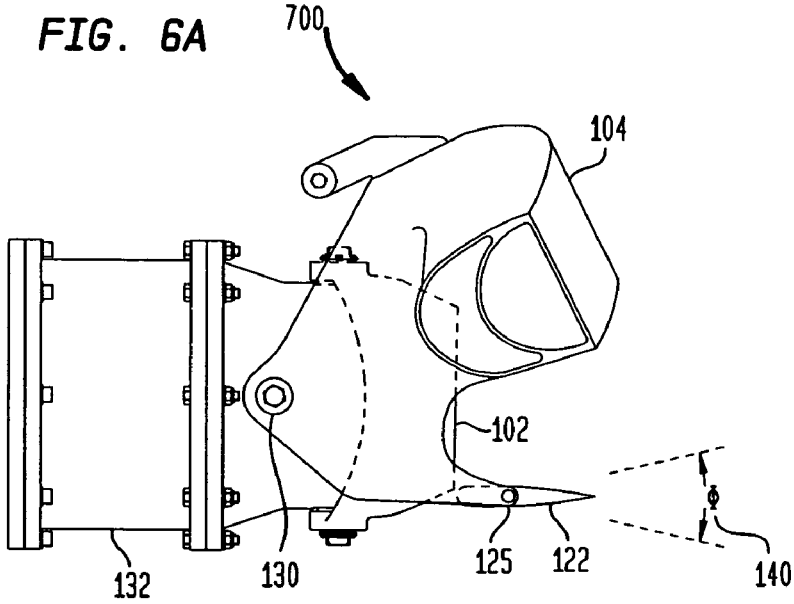
FIGS. 6*a*–6*d* illustrates another embodiment of an integral reversing deflector and trim deflector comprising movable trim deflector that has a degree of freedom about an axis.
Figure 6B:
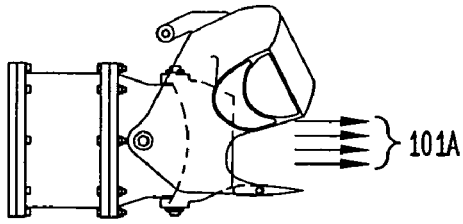
Figure 6C:
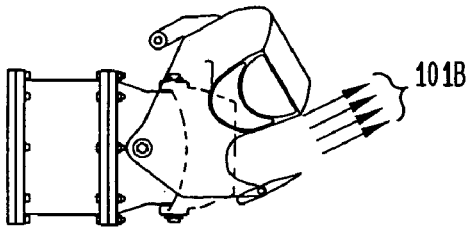
Figure 6D:
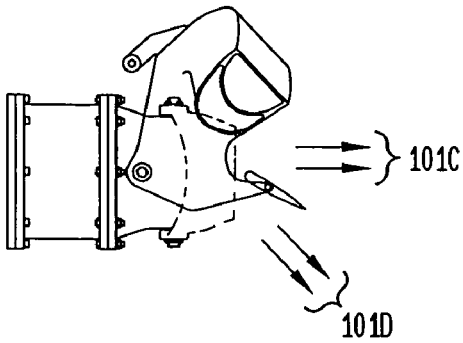

FIG. 6*a* illustrates an example of an alternate embodiment of a reversing and trim deflector apparatus 700, wherein a trim deflector 122 has a degree of freedom to rotate through an angle 140, with respect to the reversing deflector 104, by pivoting about a pivot 125. This embodiment allows for production of variable trim force depending on the position of trim deflector 122. FIGS. 6*b*–6*d* also illustrate several exemplary modes of operation of this embodiment of the reversing and trim deflector apparatus 700, including a full ahead mode, a down trim mode and an up trim mode (FIG. 6*a*).

In the full ahead mode of FIG. 6*b*, the exiting water jet steam 101A is substantially unimpeded by the reversing deflector 104 or by the trim deflector 122. In the down trim mode of FIG. 6*c*, the exiting water jet stream 101B is deflected upwards by the trim deflector 122 deflecting the exiting water jet stream, and thus generates corresponding downward trim force. Trim deflector 122 can pivot to vary the amount and direction of thrust it develops. This includes developing a vertical thrust component that may be directed upwards (up trim) or downwards (down trim). Trim deflector 122 may be moved using an actuator, such as a hydraulic actuator with one end coupled to the trim deflector 122 and another end coupled to another surface. In the up trim mode of FIG. 6*d*, the trim deflector 122 is positioned within the exiting water jet stream and rotated about pivot 125 so that a first portion of the exiting water jet stream 101C travels unimpeded along the vessels major access, while a second portion of the exiting water jet stream 101D is deflected downward by the trim deflector 122, thus generating an upward trim force. Again, it is to be appreciated that the operating modes shown are not exhaustive, and other modes of operation using this embodiment of the reversing and trim deflector apparatus 700 and variations in the design and operation thereof are possible, and within the scope of this disclosure.

Figure 7A:
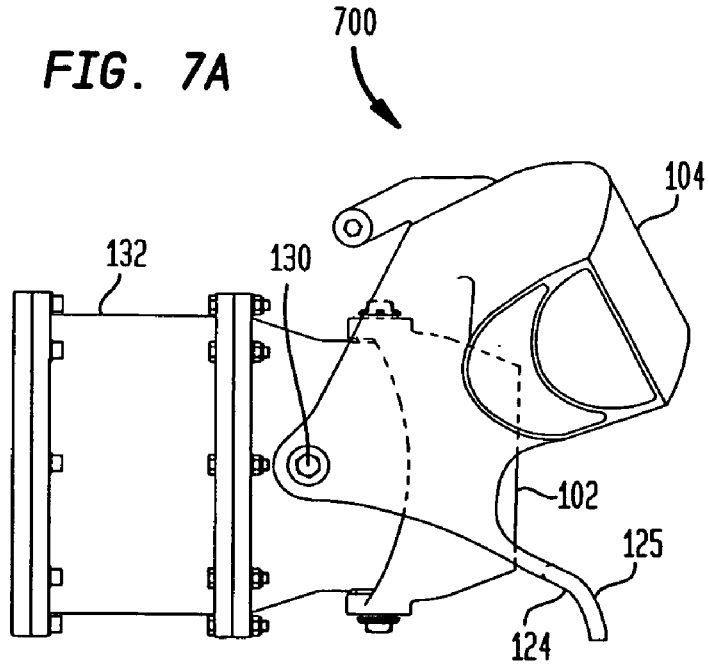
FIGS. 7*a*–7*c* illustrates another embodiment of an integral reversing deflector and trim deflector apparatus comprising a contoured surface.
Figure 7B:
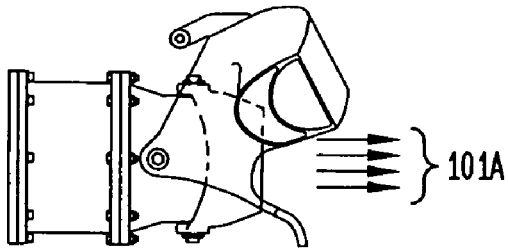
Figure 7C:
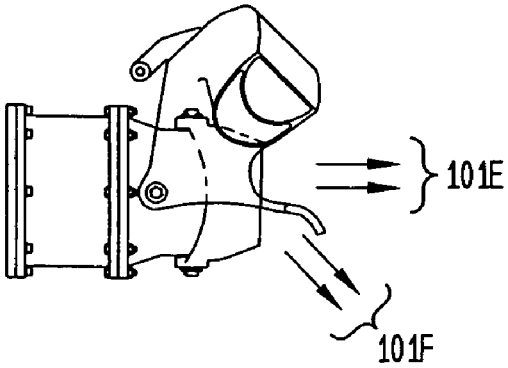

FIG. 7*a* illustrates yet another embodiment of a combined integral reversing deflector and trim deflector apparatus 700. A curved trim deflector 124 is coupled to a reversing deflector 104. The trim deflector 124 has a contour 125 or a curve associated therewith, which provides forces according to the dynamics of the deflector design and water jet stream. For example, FIG. 7*c* illustrates an up trim mode provided when a portion of the exiting water jet stream 101F is deflected downward by the curved surface of trim deflector 124. This results in an upward trim force as previously described. FIG. 7*b* illustrates a full ahead mode of operation in which both deflectors do not impede the water jet stream 101A, as has been previously described.

Those skilled in the art will recognize that the specific design of the contour 125 of trim deflector 124 can be chosen depending on the application at hand, and that different vessel dynamics and control behavior can be obtained by varying the size, shape and orientation of the curved trim deflector 124. Additionally, it should be understood that the contour 125 shown in FIG. 7*a* can be modified to include multiple contours as well as curvilinear or piecewise-continuous linear segments which may generate one or more deflection surfaces that generate one or more corresponding force components. Additionally, the embodiments shown herein and illustrated in FIGS. 7*a*–7*c* depict the trim deflector as comprising a single deflector surface, but it should be appreciated that the trim deflector 125 may comprise multiple surfaces coupled to one another or having their own degrees of freedom with respect to one another and other embodiments and variations may also be implemented as known to those skilled in the art.

Figure 8A:
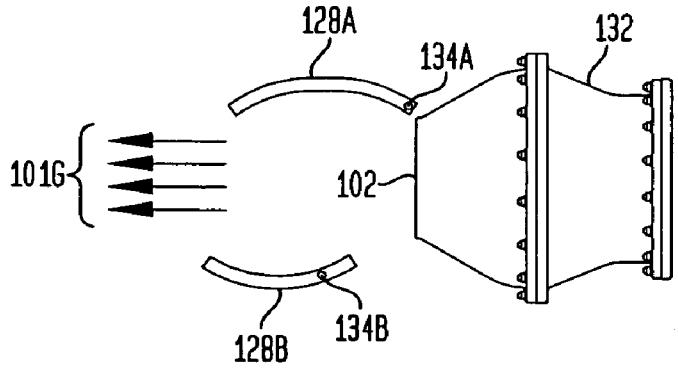
FIGS. 8*a*–8*f* illustrates a trim deflector apparatus comprising two movable deflectors to control water flow.
Figure 8B:
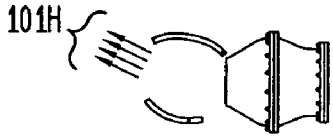

According to another embodiment of the invention, a trim deflector may comprise more than one element. FIG. 8*a* illustrates a trim deflector apparatus comprising surfaces 128A and 128B arranged with respect to an exit water jet stream 101G. Surface 128A moves about a pivot point 134A and surface 128B moves about a pivot point 134B. By controlling surfaces 128A and 128B, trim thrust may be generated as described earlier, with varying results, depending on the overall configuration provided by the combined surfaces 128A and 128B.

Figure 8C:
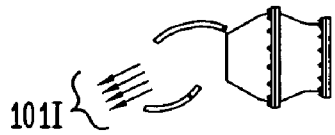
Figure 8D:
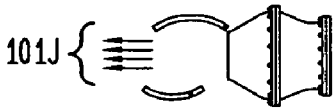
Figure 8E:
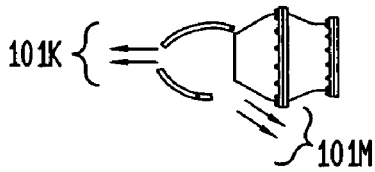
Figure 8F:
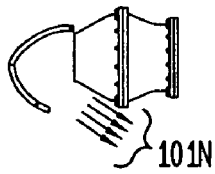

Some exemplary modes of operation of such a multi-component trim deflector 128A, 128B are illustrated in FIGS. 8*b*–8*f*. FIGS. 8*b*–8*f* illustrate trim thrust developed by deflecting the exiting water jet stream (e.g., 101J, FIG. 8*d*), to provide deflected water jet streams 101H (FIG. 8*b*) and 101I (FIG. 8*c*). FIG. 8*d* illustrates the exiting water jet stream 101J in the unobstructed (forward) running situation, where deflectors 128A and 128B are substantially out of the exiting jet stream 101J. A neutral or intermediate position may be obtained, as illustrated in FIG. 8*e*, by configuring deflectors 128A, 128B to allow a first portion of the exiting water jet stream 101K to exit to the rear, while deflecting a second portion 101M of the exiting water jet stream forward. Referring to FIG. 8*f*, a backing thrust can also be provided by positioning deflectors 128A and 128B to substantially completely block the flow of exiting water jet stream 101G to provide deflected water jet stream 101N to generate a backing thrust. It is to be appreciated that articulation of deflector surfaces 128A and 128B about pivots 134A and 134B, respectively, can be achieved by any suitable technique known to one of skill in the art, such as by using hydraulic actuators, as described earlier. Deflector's 128A, 128B do not necessarily have the same size or shape as one another, but can be of different sizes and shapes. Deflectors 128A and 128B have a curved profile in some embodiments, but may comprise other shapes as known to those of skill in the art.

Figure 9A:
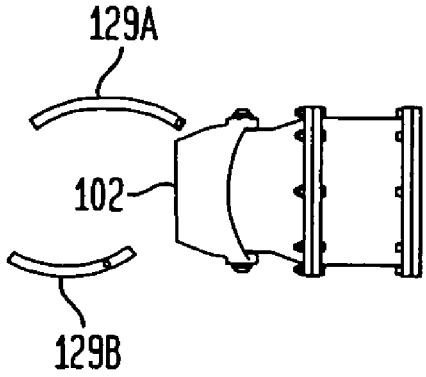
FIG. 9A illustrates the integral reversing deflector and trim deflector apparatus of FIG. 8*a* disposed outside an articulated discharge nozzle.
Figure 9B:
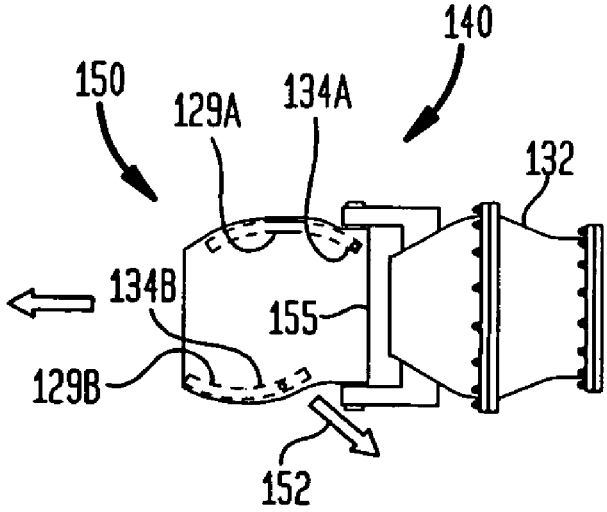
FIG. 9*b* illustrates a trim deflector apparatus of FIG. 8*a* disposed inside an articulated discharge nozzle.

Some systems comprise an articulated steering nozzle that can provide steering. Accordingly, referring to FIG. 9*a*, one design consideration is whether to place the trim deflectors 129A, 129B within an articulated steering nozzle 150 or whether the trim deflectors 129A and 129B should be placed outside the articulated steering nozzle 150. FIGS. 9*a*–9*b* illustrate two possible configurations, one in which trim deflectors 129A and 129B are placed in a location so that they may generate forces, as previously described, without being placed inside any nozzle housings.

FIG. 9*b* illustrates an alternate configuration wherein deflectors 129A and 129B are positioned inside the articulated steering nozzle 150. The articulated steering nozzle 150 is movable on a trunion 140 that allows for steering motion of the entire nozzle and deflector assembly about the pivot of the trunion 140. Trim deflectors 129A and 129B are trim deflectors which provide trim force. Trim deflectors 129A and 129B can be articulated about pivot points 134A and 134B respectively. By coordinating the movement of trim deflectors 129A and 129B it may be possible for the aft-most portions of the trim deflectors 129A and 129B to meet in such a way as to block the exiting water jet stream and cause a net backing thrust if the exiting water jet stream is forced to turn around and exit through an opening 152 in the articulated steering nozzle 150 with some forward velocity.

It is to be appreciated that various designs and modifications to the internal and external trim deflector and articulated discharge nozzle assembly are possible. Additionally, auxiliary components may be provided to achieve the modes of operation. For example, actuator elements (not shown) may be installed with one or more points coupled to the trim deflectors 129A and 129B in order to move said trim deflectors 129A and 129B. Additional bracketing or extensions (not shown) may be attached to fixed components of the marine vessels transom or other fixed components of the propulsion system. Furthermore, the trim deflectors and actuators may be coupled or fixed to a discharge nozzle.

Figure 10A:
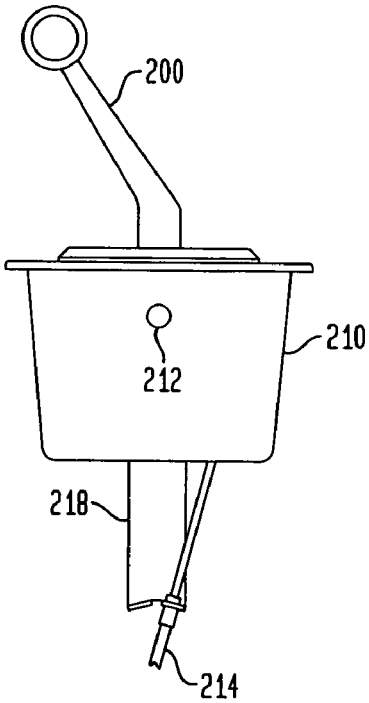
FIG. 10 illustrates a purely mechanical control lever assembly according to the related art.
Figure 10B:
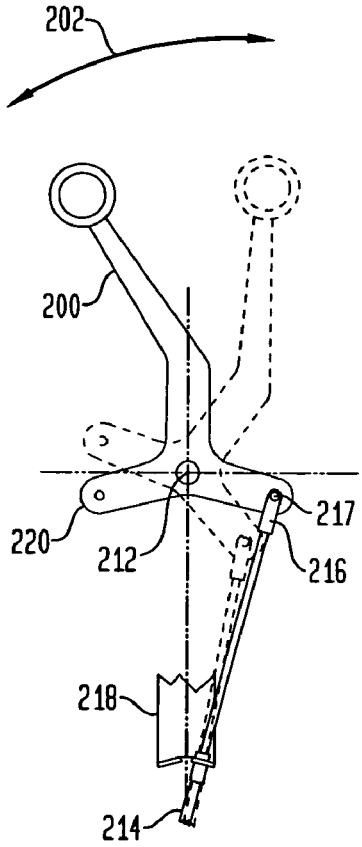

As mentioned previously, some current marine vessel control systems employ purely mechanical actuators and controls to operate the vessel's control devices and propulsion equipment. FIG. 10 illustrates a conventional mechanical apparatus for controlling a marine vessel control device and propulsion system. A control lever handle 200 can move through a range 202 by pivoting about a control lever shaft or pivot 212. The resulting angular motion of the control lever arm 220 allows movement of a cable 214, fixed to the control lever arm 220 by a clevis 216 and a pin 217. A substantially linear motion is developed in the cable 214, which is coupled to and enables operating a control actuator or mechanical propulsion control element. The control lever assembly is commonly enclosed in an enclosure 210 which provides protection from mechanical and water hazards.

Figure 11A:
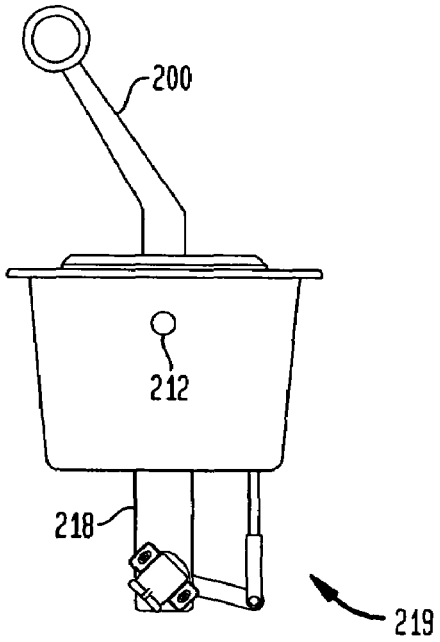
FIGS. 11*a*–11*c* illustrates an embodiment of an electro-mechanical control assembly, comprising a rotating transducer.
Figure 11B:
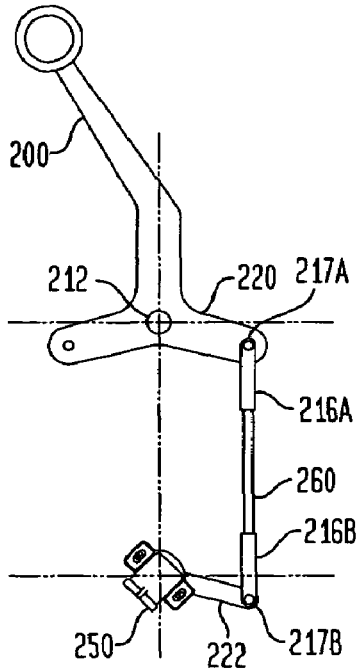
Figure 11C:
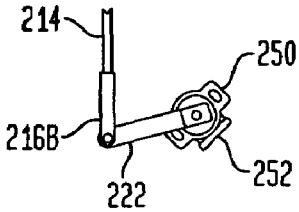

In some cases it may be desirable to provide electrical or electro-mechanical controls to interface with any electrical or electronic, e.g., computerized, control elements. Additionally, electrical instrumentation is sometimes facilitated by the use of at least partially electrical control devices. In order to achieve an electrical control signal, rather than using a purely mechanical control apparatus, according to some embodiments of the invention a transducer is provided which can convert a mechanical motion into a corresponding electrical signal. FIGS. 11*a*–11*c* illustrate a control lever assembly 219 having a control lever handle 200 and a control lever arm 220 as described previously. However, the assembly 219 has replaced the mechanical cable arrangement 214 with a connecting link 260; a second lever 222 and a rotary transducer 250. The connecting link 260 connects the control lever arm 220 with a second lever 222 by clevis and pin connectors 216A, 217A, and 216B, 217B. Movement of the control lever handle 200 results in movement of the control lever arm 220, which is transmitted by the connecting link 260 to the second lever 222.

Transducer 250 rotates about a pivot point 252 and receives a mechanical position input from the second lever 222, corresponding to the motion of the control lever handle 200. Responsive to such movement of the control lever handle 200, the transducer 250 rotates about its pivot 252 and provides an electrical output signal corresponding to the mechanical control lever handle movement. In this way, the mechanical movement of the control lever assembly is transformed into an electrical signal indicative of a control movement by the marine vessel operator.

A mechanical response and feel of the movement of the control lever handle 200 may be simulated by optionally installing mechanical resistance elements, such as springs and bushings, etc. that help the marine vessel operator have the same tactile experience in operating this electro-mechanical control device as the operator would experience when operating a purely mechanical control device. This may be achieved in some embodiments by use of frictional elements at the pivot points.

Figure 12A:
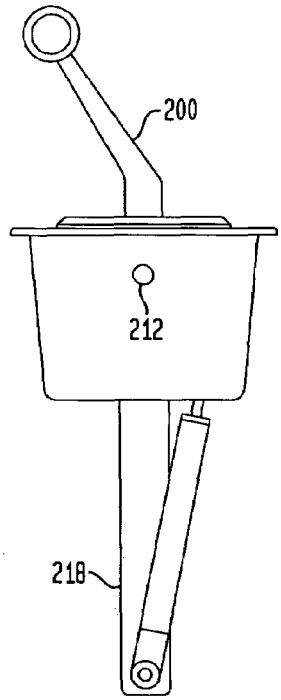
FIGS. 12*a*–12*b* illustrates another embodiment of an electro-mechanical control assembly, comprising a linear transducer.
Figure 12B:
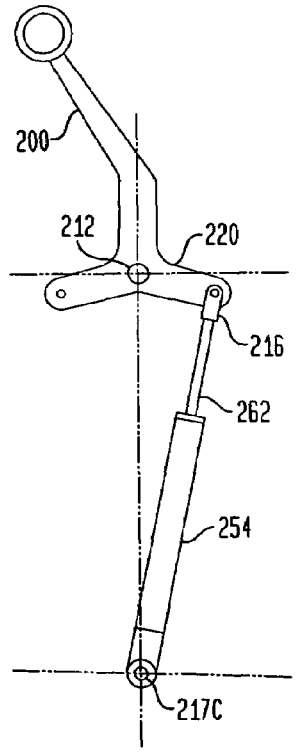

FIGS. 12*a*–12*b* illustrate another embodiment of a mechanical-to-electrical control signal conversion apparatus. Movement of control lever handle 200 and control lever arm 220 is transmitted to a linear transducer 254, which detects the position and movement of shaft 262. The shaft 262 does not move linearly with respect to the control lever handle 200 due to the nonlinear, or circular, motion of control lever arm 220. Since the control lever handle 200 and the control lever arm 220 rotate in a circular motion about control lever shaft or pivot 212, a circular-to-linear conversion algorithm may be employed to convert the nonlinear movement delivered to the linear transducer 254 into a corresponding linear signal.

Alternatively, this conversion is not used, or can be accommodated and accounted for in the subsequent behavior and modulation of the actuators and control surfaces to compensate for this nonlinearity. It is to be appreciated that analog or digital circuits can be used to achieve circular-to-linear compensation.

It is to be appreciated that the foregoing examples are illustrative embodiments of a mechanical-to-electrical control assembly which may be modified, for example, to have fewer or more connecting links and employing offsetting shafts, reducing gears, cams, etc., and that such modification may depend on a specific application. For example, the ends of connecting device or link 260 may comprise pinned devises or spherical rod ends or ball joints.

In some instances, it is desirable to convert an existing mechanical system into an electro-mechanical system, as discussed above. To reduce costs of conversion from a purely mechanical to an electro-mechanical control system, certain parts of any of the above-described control assembly and transducers may be provided as a conversion kit to convert existing marine vessels. For example, an existing mechanical control system, such as the previously-described cable arrangement 214 can be disconnected or removed from an existing system and can be replaced by a suitable connecting link 260 and transducer 250 apparatus. Since the control lever handle 200 and associated housing 210 are usually a significant part of the system's cost, conversion costs can be reduced with the conversion kit. Also, since the operator does not observe the inner components of the control lever assembly, owner preferences for the look and feel of the vessel's controls and instrumentation can be retained.

Various propulsion and control parameters may be controlled using such a conversion mechanism. For example, engine RPM, clutch position, propeller pitch, reversing deflector position, or any control surface or control lever may employ such a device.

Figure 13:
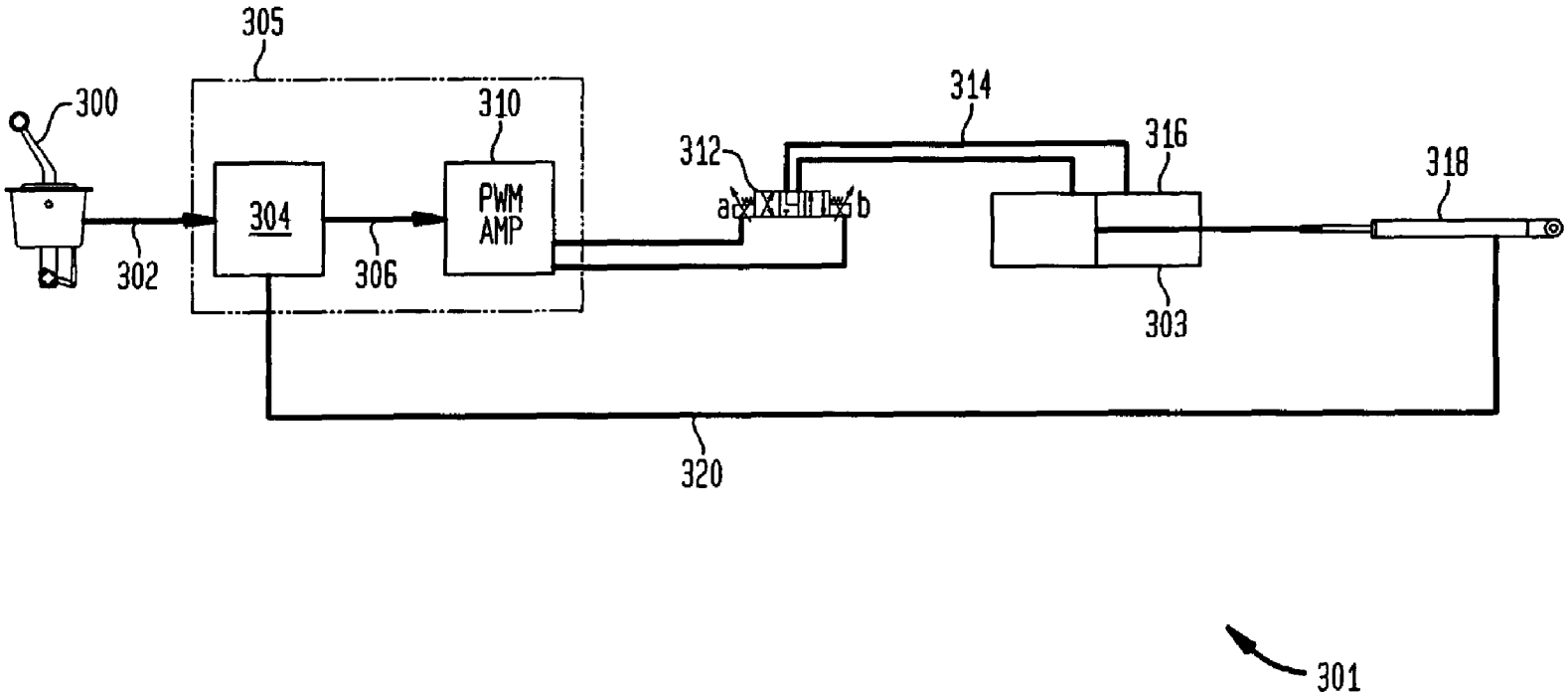
FIG. 13 illustrates a simple electro-hydraulic control system for controlling a hydraulic actuator.

FIG. 13 illustrates a simplified schematic of a marine vessel control system 301 depicting one control element actuator 303. A control lever assembly 300 is converted or equipped with a mechanical movement to electrical signal output transducer arrangement, such as by using a transducer, as described previously. A marine vessel operator operates the control lever assembly 300 and a corresponding electrical signal is produced at line 302 and delivered to the control system 301. In particular, a voltage signal is developed at line 302 which is provided to a processor 304 that processes the electrical input signal at line 302 and provides an output signal at line 306. The output signal at line 306 is delivered to an amplifier 310 that amplifies the signal at line 306 to a sufficient level to control the actuator 303. In some embodiments, the voltages at the input of the processor 304 or the amplifier 310 are converted to electrical currents for driving other electrical or electro-mechanical components of the system. According to one aspect of this embodiment of the control system, the processor 304 and the amplifier 310 are enclosed within a control box 305.

In the embodiment illustrated in FIG. 13, an electrically-driven proportional directional valve 312 receives output current signals provided by amplifier 310. Electrical control solenoids at either end of the proportional directional valve 312 control the flow in the valve's interior hydraulic fluid passages and valve ports, opening and shutting respective fluid passages and valve ports as controlled by the marine vessel operator via the controller 300.

Hydraulic lines 314 provide for hydraulic fluid flow to extend or retract an actuator arm in a hydraulic cylinder 316 of actuator 303. Actuation of the actuator 303 is now possible and can be sensed and measured with a potentiometer 318. Potentiometer 318 provides a voltage signal at line 320 which is a feedback signal that is fed back to processor 304 on line 320. In this way the electrical portion of the control system can sense and better control the mechanical and hydraulic portion of the control system.

As an example of the operation of the system illustrated in FIG. 13, a marine vessel operator can deploy and retract a reversing deflector. For example, the operator can move a member of the control lever assembly, such as a control lever handle 200 (see FIGS. 11–12), in a first direction. A corresponding voltage signal is generated at line 302 and provided to processor 304. Processor 304 compares the voltage signal at line 302 with a second voltage signal at line 320 and provides an output signal at line 306 corresponding to a difference between the desired and the actual position of the reversing deflector. The signal at 306 is delivered to an amplifier 310 that amplifiers the difference signal and produces a corresponding electrical signal to modulate the proportional directional valve 312 to a desired position. Hydraulic fluid flows into cylinder 316 on a first side of a piston and flows out of cylinder 316 from a second side of said piston. The resulting movement of the piston arm actuates a reversing deflector, moving it in a direction as provided by the vessel operator. Potentiometer 318 delivers a voltage signal on line 320, indicative of the position of the reversing deflector to processor 304. When the reversing deflector reaches the desired position, no difference exists between the signals at lines 320 and 302, and processor 304 delivers a neutral or zero reference voltage to its output at line 306.

Figure 14:
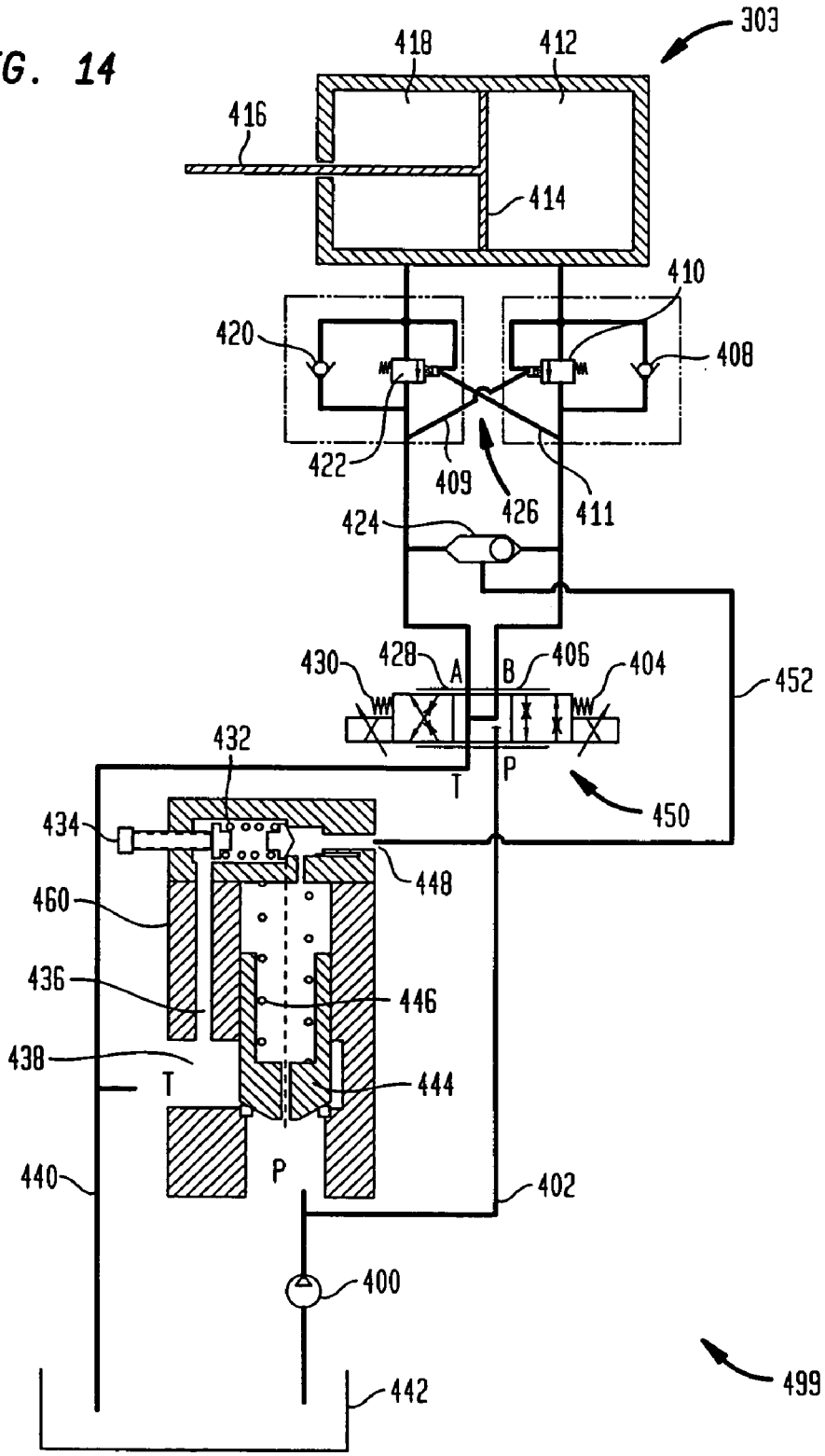
FIG. 14 illustrates an embodiment of a hydraulic actuator control circuit comprising a vented relief valve according to the present invention.

FIG. 14 shows an exemplary embodiment of a hydraulic circuit 499 for controlling a hydraulic actuator 303. Actuator 303 may be used to move a marine vessel control surface such as the reversing deflector and trim deflector apparatus discussed herein (not shown). The actuator 303 comprises two hydraulic chambers 418 and 412, separated by a piston 414. The piston 414 moves in response to pressure differences between chambers 412 and 418. Piston 414 is connected to a sliding shaft, or rod, 416 which directly, or indirectly through linkages, moves the deflector apparatus. Hydraulic pressure is provided to actuator chambers 412 and 418 via a controllable multi-port hydraulic valve 450.

One type of multi-port hydraulic valve suitable for use to direct hydraulic fluid to an actuator is a directional proportional valve. This type of valve is capable of providing several flow configurations and controls the flow of hydraulic fluid proportional to an actuation input such as an electric current. One embodiment of the present invention employs a solenoid-actuated, 3-position, 4-way, spring-centered directional proportional valve 450. A pair of electrical solenoids 404 and 430 place valve 450 in one of its three possible positions to alternately open or close various passages within the valve, connecting corresponding valve ports (A, B, T and P).

Ports "A" and "B" of valve 450 are connected to the actuator chambers 418 and 412 through a counter balance valve assembly 426. The cross-locking valve assembly 426 prevents the actuator 303 from moving due to load variations, e.g. from water waves and drag forces. To protect the actuator 303 and its components from damage due to high loads and pressures within chambers 412, 418, relief valves 410 and 422 are provided that relieve pressure above some setpoint back, through valve 450 to the tank 442.

Since hydraulic fluid is substantially incompressible, when a supply of fluid is delivered to one of the two actuator chambers 412 and 418, a return path must be provided for the exiting fluid leaving the other chamber, 418 and 412. The hydraulic system of FIG. 13 operates as follows.

To retract the rod 416 of actuator 303, solenoid 430 is actuated from the marine vessel controls to allow pressurized hydraulic fluid to flow from the pump 400, through port "P" of valve 450 and out port "A" of valve 450. Flow from port "A" is then delivered to actuator 303 chamber 418 through check valve 420. Fluid leaves chamber 412 when piston 414 moves to the right. The fluid leaving chamber 412 passes through valve 410 (which is opened by pilot pressure from line 409) then passes through to tank 442 through ports "B" and "T" of valve 450.

Similarly, to extend rod 416, solenoid 404 is electrically actuated to provide pressurized hydraulic fluid from the pump 400 through valve 450, passing from the "P" to the "B" port of valve 450. Fluid is then provided from the "B" port to chamber 412 of actuator 303 through check valve 408. Pilot pressure from line 411 opens valve 422 and allows fluid to exit chamber 418 through valve 422 and passes back to the tank 442 through ports "A" and "T" of valve 450.

In addition, the system illustrated in FIG. 13 comprises a vented relief valve and load sensing arrangement. Vented relief valve 460 has three ports: "P" coupled to the pressure side of pump 400, "T" coupled to the tank 442 through line 440, and a third port 448 coupled to a load-sensing line 452. The load-sensing line 452 receives the higher of the two input pressures at shuttle valve 424. Shuttle valve 424 is a three-port valve, which may be implemented as two back-to-back check valves, and opens load-sensing line 452 to either of the lines leading to the two sides of the cross-locking valve assembly 426, depending on which is at a higher pressure.

In normal operation, when no actuator movement is occurring, hydraulic fluid flows from port "P" to port "T" of vented relief valve 460, allowing the pump 400 to operate at constant flow and reduced pressure output. This situation puts the pump in a low-power standby mode, sometimes called "kicked down." Poppet 444 is unseated, opening flow from "P" to "T" because pressure bleeds from the back of poppet 444, up through shuttle valve 424 and back down through valve 450 to the tank 442. A nominal 150 psi drop across valve 460 and valve 450 exists because of a spring 446 stiffness, which is typically set to open at about 150 psi. It is to be appreciated that a 150 psi setting is not meant by way of limitation, and the spring 446 may have a different stiffness and pressure drop.

If rod 416 were to reach the end of its travel range ("bottoming out") or if the load or actuator 303 become stuck or experienced an excessively large resistance to their movement, the pressure relief system protects the hydraulic circuit and its components. For example, if actuator rod 416 bottoms out while the operator still delivers a control input to keep moving the actuator past its maximum travel point, pressure in the pressurized chamber of the actuator will continue to rise. This is because the bottomed-out actuator is receiving the full pressure of pump 400 and no motion of the piston 414 is occurring. Hence pump pressure continues to increase to deliver the flow to the actuator. Recall that pump 400 is a constant-flow pump, e.g. a positive displacement or reciprocating pump that increases the output pressure to maintain flow rate. Pumps like pump 400 can attain very high pressures (5000 psi to 7000 psi) and can exceed the safe operating pressure of the hydraulic lines and other components in the system. Thus, a pressure-relief system is needed to protect from an over-pressure condition.

Accordingly, a highest pressure at the load side of the hydraulic control system is sensed using shuttle valve 424, as described earlier. One embodiment in which a load-sensing shuttle valve 424 is implemented is by placing two check valves back-to-back in place of the shuttle valve such that only the higher of the two pressures arriving at the shuttle valve input ports is transmitted out to the load-sensing line 452. Thus, the load-sensing line provides an approximation of the highest load or pressure due to the actuator. The system load is caused by resistances and forces applied to the actuator rod 416 as it moves and holds a control surface in contact with water, thus resisting lift, drag and other water forces on the control surface. A load-side pressure may be defined by the hydraulic pressure required to hold and maintain the load against external forces and internal resistance forces.

The highest pressure is provided to a pilot valve 432 in vented relief valve 460 through port 448. If the highest sensed pressure exceeds a predetermined setpoint, set by adjusting screw 434, spring-loaded pilot valve 432 will unseat, and pressure is relieved through vent drain 436 to the tank 442.

The above system of FIG. 14 was illustrated for controlling a single actuator 303. However, it is to be appreciated that a modified system can be used to control more than one actuator or load circuit. We now turn to one embodiment of a system for controlling more than one actuator, such as are found on many marine vessels having a number of different control surfaces actuated by separate actuators.

Figure 15:
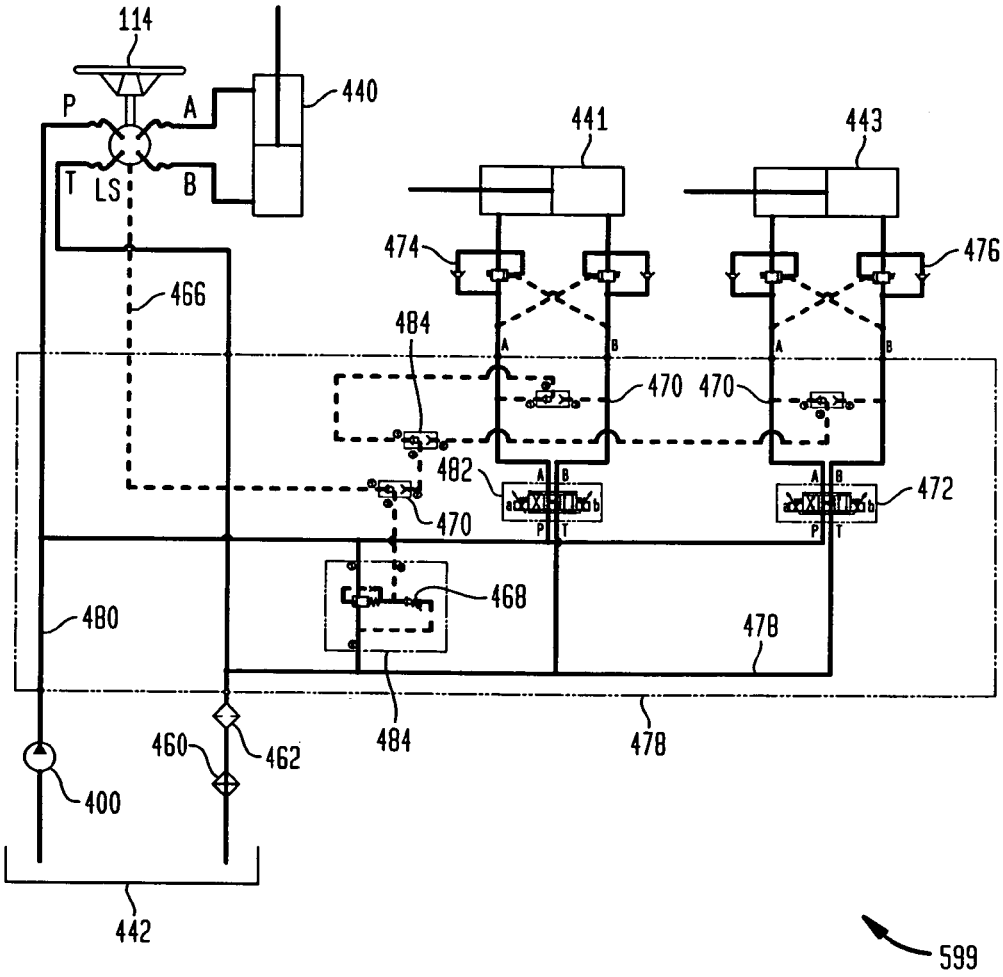
FIG. 15 illustrates an embodiment of a hydraulic actuator control circuit comprising a load sensing network and a single vented relief valve.

Referring to FIG. 15, a hydraulic control and actuation system 599 is illustrated having three actuators 440, 441 and 443 that actuate three control surfaces or deflectors. In the embodiment illustrated in FIG. 15, helm or steering wheel 114 controls hydraulic fluid flow to steering or helm actuator 440. A steering pump, such as model 213-4001 available from the EATON Corporation, of Eden Prairie, USA, provides power-steering. As described previously, some systems, especially on larger vessels are difficult or impossible to steer without hydraulically-assisted actuation of the steering actuator 440. This is also true for movement of other control surfaces and devices such as reversing deflectors.

Additionally, the system of FIG. 15 has two directional proportional valves 472 and 482 that are actuated electrically, as described earlier, and control hydraulic fluid flow to actuators 441 and 443, which actuate port and starboard reversing deflectors, respectively.

The actuators 440, 441 and 443 operate by differential hydraulic fluid pressure across their respective pistons and drive their respective rods in or out to control their respective control surfaces.

Hydraulic fluid pressure source, pump 400, provides the required pressure for such actuation through the directional proportional valves 472 and 482 and through the counter balance valve assemblies 474 and 476. The directional proportional valves 472 and 482, as well as the pilot-to-open counter balance assemblies 474 and 476 operate essentially as described earlier with respect to FIG. 14. However, in this circuit, the load-sensing network, comprising shuttle valves 470 operates in a cascaded fashion to sense the highest of the several pressure lines coming from either side of each of the actuators in the circuit. It can be seen that in a circuit with three actuators, a total of six pressures are compared to deliver the highest of the six pressures to the pilot port of the vented relief valve 484. Vented relief valve 484 operates substantially as described earlier with respect to FIG. 14. Again, load-sensing can be accomplished by using shuttle valves 470, wherein each shuttle valve may be replaced by a pair of back-to-back check valves. Bleed-down orifices may be used to bleed pressure from the check valves, as known to those skilled in the art.

Since the load-sensing network of FIG. 15 requires free flow to and from each of the steering and deflector actuators, pressure transients in any of these lines will be transmitted to the other parts of the hydraulic circuit. In particular, pressure transients due to trapped and released hydraulic fluid in the steering system are not prevented from travelling across the pressure and the load-sensing hydraulic lines and can adversely affect the other components of the circuit. This can be problematic in conventional systems, as isolation of steering system pressure spikes, especially in the load-sensing lines, or transients is generally incompatible with normal operation of the load sensing network as described below.

One proposed solution to isolate the steering hydraulics from the remaining parts of the hydraulic control system, especially the load-sensing network, would entail placing a check valve that allows one-way flow of hydraulic fluid in load-sensing line 466 in a direction away from the load-sensing network. However, placing such a check valve in line 466 would defeat the purpose of coupling the steering hydraulics to the load-sensing network, as the pressure in the steering system cannot be measured without a free flow path from the steering system.

One manifestation of the problem described herein due to propagation of hydraulic pressure transients is "kickback" of a control apparatus such as a steering wheel or helm. Operators of marine vessels and other craft and machines using hydraulic control systems experience kickback in the form of an undesired and sudden jerking of the control lever or steering wheel or helm in the hands of the operator. This condition, in addition to being an irritant to the operators, can be hazardous as the operator can be in some cases injured and/lose control of the machine or vessel being operated. Accordingly, the solutions and embodiments presented herein are meant to encompass solutions to equivalent or similar problems experienced in more than marine vessel control systems. For example, any hydraulic control system experiencing high pressure transients or low pressure transients that propagate through the control system may take advantage of the improvements and solutions according to the present invention. Specifically, hydraulic control systems used in land, air and sea vehicles may employ aspects of the present invention. Heavy equipment, such as construction equipment and agricultural equipment, may also benefit from various aspects of the present invention.

The above-mentioned problem is solved according to one aspect of the present invention by placing a second multi-port vented relief valve 464 in the hydraulic control circuit such that a portion of the hydraulic control circuit, e.g. the steering portion, has its own pressure relieving vented relief valve. In one embodiment of the invention, illustrated in FIG. 16, the load-sensing port and line from the steering controls 114 is coupled to the vent port (port "3") of the multi-port vented relief valve 464. According to this embodiment, a check valve 490 may also be placed in the load-sensing line 490 between the steering system and the multi-port hydraulic vented relief valve 464, achieving the desired goal of preventing steering system pressure transients from propagating into the hydraulic control system at large. Check valve 491 similarly prevents reverse flow of hydraulic fluid, e.g. due to pressure transients, in the pressure lines of the control system circuit. However, since the pressure line is not a load sensing line the pressure line does not typically pose a problem in the same sense that one-way flow in a load sensing line would cause a problem with the load sensing procedure as described earlier. It should be noted that check valve 490 can be adjustable, e.g., using a setting that determines a pressure at which check valve 490 is actuated. This can be useful to control the pressure drop between ports "1" and "2" of vented relief valve 464.

Figure 16:
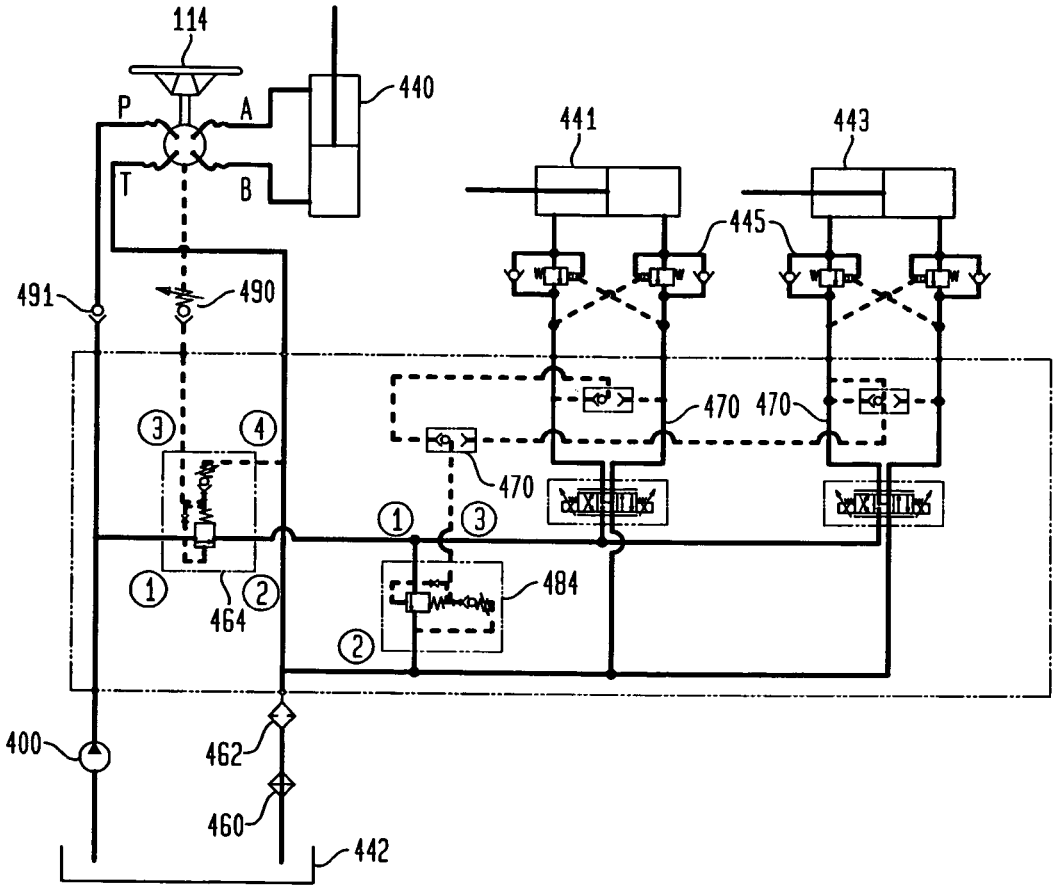
FIG. 16 illustrates an embodiment of a hydraulic actuator control circuit with a load sensing network and two vented relief valves.

In some embodiments of the invention, an externally-drained vented relief valve 464 is used. According to these embodiments, the vented relief valve 464 has a port (port "4") which is opened to a low pressure (tank) side of the hydraulic control circuit. FIG. 16 shows this configuration, where external drain port (port "4") drains through a filter 462 and a cooler 460 into the reservoir tank 442.

By their design, the vented relief valves 464 and 484 typically require 50–150 psi of differential pressure for fluid to flow through the valves. When no steering is occurring, load-sensing line 490 is open to the system pressure on line 491.

During normal running operation, when no movement of actuators 440, 441 and 443 is occurring, flow from pump 400 flows up in the "P" lines, through ports "1" and "2" of vented relief valve 464 and ports "1" and "2" of vented relief valve 484. The hydraulic fluid circulates back to tank 442 through filter 462 and the cooler 460 as discussed above. The actuators 441 and 443 are held in place by their respective pilot-to-open counter balance valve arrangements 445.

When motion of a deflector is desired, for example, deflector actuators 441 or 443 are moved as described previously by passing fluid from the pressurized "P" ports to the appropriate "A" or "B" ports of the respective directional proportional valves. Load sensing occurs (at least in part) through shuttle valves 470.

Figure 17:
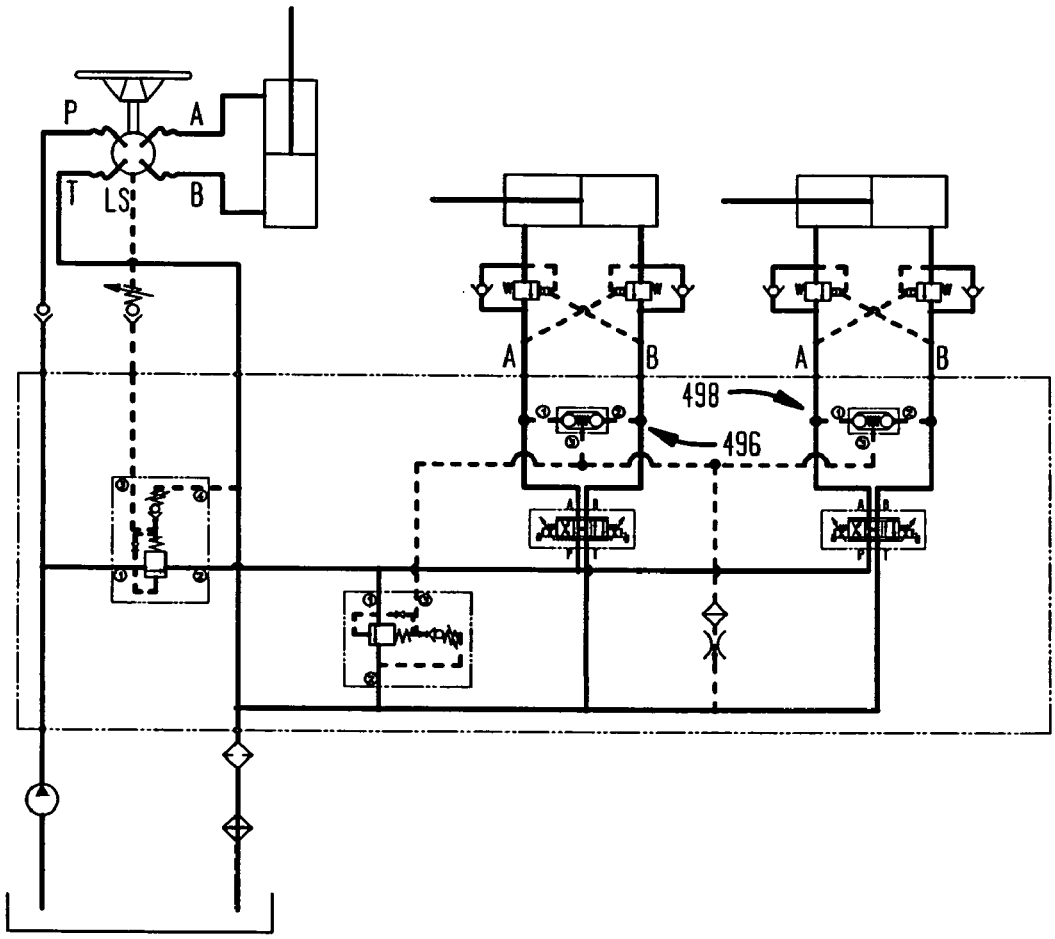
FIG. 17 illustrates another embodiment of a hydraulic actuator control circuit using back-to-back check valves in the load-sensing network.

It should be understood that vented relief valves 464 and 484 can be constructed by a suitable combination of other hydraulic elements and components rather than being constructed as a single vented relief valve as described. One skilled in the art would appreciate that other components described in the embodiments given herein could also be substituted with equivalent components or combinations of components to achieve similar results. For example, the shuttle valve 440 and 470 could be substituted with two back-to-back check valves. This configuration is shown as arrangements 496 and 498 in FIG. 17. It to be appreciated that the hydraulic circuit of FIG. 17 operates substantially similarly to that described in FIG. 16, except where indicated on the drawing or in the present description. Hence, for the sake of brevity, a full description of the arrangement and operation of the hydraulic circuit of FIG. 17 is omitted.

Figure 18:
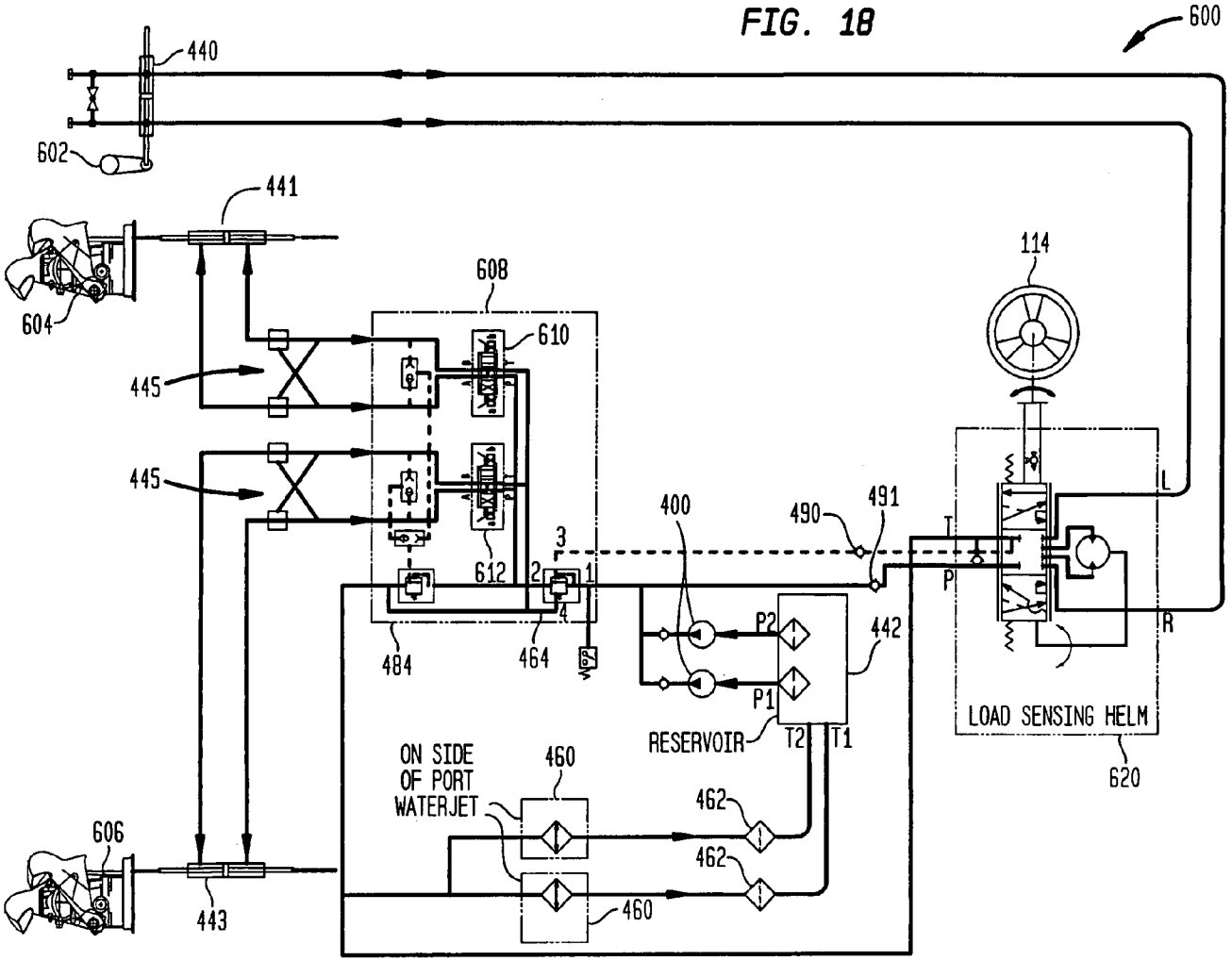
FIG. 18 illustrates an embodiment of a system having two pumps and illustrates an exemplary load-sensing helm device.

FIG. 18 illustrates yet another embodiment of a hydraulic control circuit 600 according to the present invention. The figure illustrates the connectivity of the loads to the control system. Dual pumps 400 providing 8.5 GPM of hydraulic fluid and are operated concurrently or individually and act as a hydraulic pressure source in circuit 600. Pressurized fluid flows through check valve 491 to the control surface actuators to actuate a plurality of control surfaces and devices, as well as to load-sensing helm control circuit 620. Actuators 441 and 443 operate to respective reversing buckets 604 and 606. Actuator 440 is used to operate a tiller 602. Manifold 608 comprises two proportional directional valves 610 and 612 as well as a load-sensing network coupled to actuators 441 and 443. In addition, the manifold 608 comprises two vented relief valves, a first vented relief valve 484 having three ports and being internally drained, and a second vented relief valve 464 having four ports and being externally drained, as described earlier. A check valve 490 is placed between the load-sensing port of the load-sensing helm 620 and vented relief valve 464 as previously described. Auxiliary components such as coolers 460 and filters 462 are also illustrated in the figure, as is a reservoir tank 442. Piloted counterbalance valve arrangement 445 operates similarly to that discussed previously. It is to be appreciated that similar components of FIGS. 17 and 18 are provided with the same reference numbers, and for the sake of brevity, a discussion of these components is not repeated.

Figure 19A:
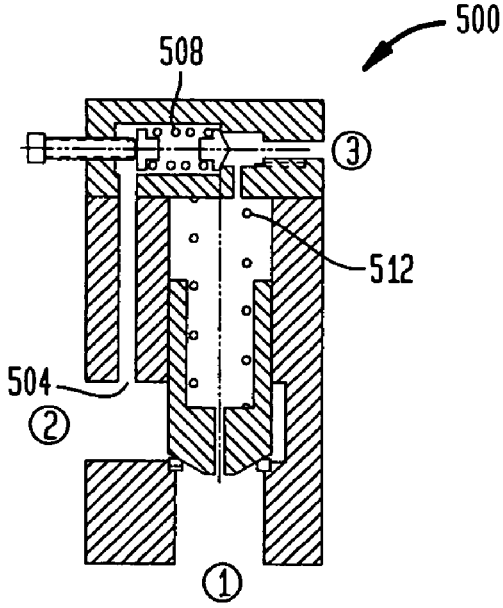
FIG. 19*a* illustrates an exemplary externally-drained multi-port vented relief valve.
Figure 19B:
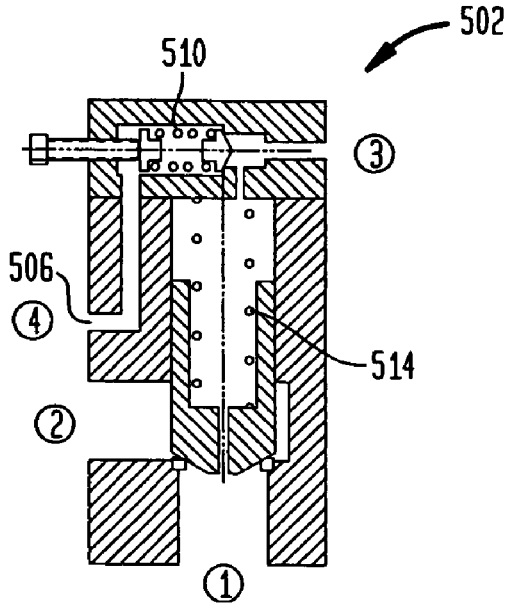
FIG. 19*b* illustrates an exemplary internally-drained multi-port vented relief valve.

FIG. 19 illustrates cross-sectional views of two exemplary hydraulic vented relief valves. Valve 500 is internally-drained, and discharges the drainage of the pilot valve 508 to port "2" of the vented relief valve. Some aspects of the present invention derive a benefit from using externally-drained vented relief valves for valve 464 of FIGS. 16–18. One reason for using externally-drained vented relief valves is described as follows.

Consider the situation where one of the deflectors (previously described) is bottomed out at the end of its travel range, or is otherwise stuck and prevented from moving. The pressure at the load sensing line and port "1" of valve 484 will increase as pump 400 increases its output pressure. At some point the pressure will exceed the setpoint of the relief pilot valve of vented relief valve 484. Pressure at ports "1" and "3" of valve 484 will therefore be approximately at the relief setting (e.g., 1000 psi). Port "2" of vented relief valve 464 is then referenced to this high (1000 psi) pressure. If the steering actuator were to bottom out and lift the relief pilot valve of valve 464 while in this condition, an internally-drained vented relief valve 464 would relieve at an even higher pressure (e.g., 2000 psi) rather than the desired relief pressure setting (1000 psi).

Hence, it is desirable in some embodiments of the present invention to use externally-drained vented relief valves such as valve 502 of FIG. 19 for valve 464 of the circuit of FIGS. 16–18, to keep the relief setting of the steering system referenced to the tank pressure rather than referenced to port "2" of valve 464. That is, having valve 464 be externally-drained provides a tank-pressure reference point for the relief setting of valve 464 instead of that valve being floating and dependent on the relief pressure on valve 484.

The concepts presented herein may be extended to systems having any number of control surface actuators and are not limited to the embodiments presented herein. Modifications and changes will occur to those skilled in the art and are meant to be encompassed by the scope of the present description and accompanying claims. It is, therefor, to be understood that the appended claims are intended to cover all such modifications and changes as fall within the range of equivalents and understanding of the invention.

What is claimed is:

1. A device for controlling thrust in a marine vessel, comprising:

a deflector apparatus having at least two deflector surfaces comprising:

a first deflector surface that deflects a water jet stream exiting a steering nozzle to provide a backing thrust when the deflector apparatus is in a first position; and a second deflector surface that deflects the water jet stream to provide a trim force when the deflector apparatus is in a second position; and wherein said deflector apparatus is configured so that it cannot be in both said first and said second positions simultaneously;

wherein the first and second deflector surfaces are arranged with respect to one another so that they cannot both be placed in said water jet stream simultaneously.

2. The device of claim 1, wherein the first deflector surface is a reversing bucket.

3. The device of claim 1, wherein the second deflector surface is configured such that the trim force has substantially no backing thrust component.

4. The device of claim 1, wherein the second deflector surface comprises a substantially planar surface that deflects the water jet stream.

5. The device of claim 1, wherein the first and second deflector surfaces are arranged with respect to one another so that they deflect the water jet stream substantially exclusively.

6. The device of claim 1, wherein said second deflector surface has a substantially U-shaped profile.

7. The device of claim 1, wherein the second deflector surface is coupled to the first deflector surface by an articulated coupling that allows for motion of the second deflector surface with respect to the first deflector surface in at least one degree of freedom.

8. The device of claim 1, wherein the deflector apparatus comprises an integral unit that includes the first and second deflector surfaces.

9. The device of claim 1, wherein the deflector apparatus comprises at least two components, a first component that includes the first deflector surface and a second component that includes the second deflector surface, said first and second components being coupled to one another.

10. The deflector apparatus of claim 1, further comprising a pivot that provides at least one degree of freedom for movement of the deflector apparatus.

11. The device of claim 10, wherein the pivot of the deflector apparatus provides a degree of freedom about an axis substantially perpendicular to a direction of the water jet stream.

12. The device of claim 1, wherein said degree of freedom comprises angular positions about the axis and said degree of freedom allows for a first angular position about said axis and a second angular position about said axis.

13. The device of claim 1, wherein the first position is a first angular position of the deflector apparatus about a pivot, and the second position is a second angular position of the deflector apparatus about the pivot.

14. A method for generating a backing thrust and a trim force for use in a marine vessel control apparatus, comprising:

providing a first deflector that in a first position deflects a water jet stream exiting a steering nozzle in a first direction to provide said backing thrust; and providing a second deflector, coupled to said first deflector and moving in unison with said first deflector, that in a second position deflects said water jet stream in a second direction to provide said trim force;

wherein providing said first deflector and said second deflector comprise providing the deflectors so that said backing thrust and said trim force are provided substantially exclusively of one another; and wherein providing said first deflector and said second deflector comprise coupling said second deflector to said first deflector so that the first and second deflectors can not be moved into said water jet stream simultaneously.

15. A method for providing reversing and trimming forces in a marine vessel, comprising:

rotating a reversing deflector about a common axis;

rotating a trim deflector in unison with the reversing deflector about said common axis so that said reversing deflector and trim deflector cannot be moved into a water jet stream exiting a steering nozzle simultaneously, and so that said reversing deflector and trim deflector deflect the water jet stream substantially exclusively of one another, thereby providing a respective backing thrust and trimming force.

16. The method of claim 15, wherein the act of rotating said reversing and trim deflectors comprises rotating said reversing and trim deflectors in unison about the common axis along an arc, a first end of the arc positioning the reversing deflector in said water jet stream and a second end of the arc positioning the trim deflector in said water jet stream.

17. The method of claim 16, wherein the act of rotating the trim deflector and reversing deflector further comprises rotating said reversing and trim deflectors in unison about the common axis along the arc to an intermediate position between said first and second ends that provides for said water jet stream to pass between said reversing deflector and said trim deflector substantially unimpeded.

18. The method of claim 15, further comprising adjusting a magnitude of said trimming force by adjusting an amount by which said trim deflector deflects said water jet stream.

19. The method of claim 15, further comprising coupling said trim deflector to said reversing deflector as a U-shaped deflector affixed to said reversing deflector.

20. The method of claim 15, further comprising coupling said trim deflector to said reversing deflector with an articulated coupling that provides for movement of said trim deflector with respect to said reversing deflector.

21. A method for providing reversing and trimming forces in a marine vessel, comprising:

rotating a reversing deflector and a trim deflector in unison along a path of travel about a common axis;

deflecting a water jet stream with the reversing deflector at substantially a first end of the path of travel to provide a backing thrust;

deflecting the water jet stream with the trim deflector at substantially a second end of the path of travel to provide substantially only a trimming force; and wherein the act of rotating the reversing deflector and the trim deflector comprises rotating the reversing and trim deflectors to the second position so that the reversing deflector and the trim deflector cannot be in the water jet stream simultaneously.

22. The method as claimed in claim 21, further comprising adjusting a magnitude of the trimming force provided by the trim deflector by adjusting an amount by which said trim deflector deflects the water jet stream.

23. The method as claimed in claim 21, further comprising providing the trim deflector as a U-shaped deflector affixed to the reversing deflector.

24. The method as claimed in claim 21, further comprising the act of rotating the trim deflector and the reversing deflector to an intermediate position between the first and second end positions that provides for the water jet stream to pass between the reversing deflector and the trim deflector substantially unimpeded.

25. The method as claimed in claim 21, further comprising coupling said trim deflector to said reversing deflector within articulated coupling that provides for movement of the trim deflector with respect to the reversing deflector.

* * * * *

UNITED STATES PATENT AND TRADEMARK OFFICE

CERTIFICATE OF CORRECTION

PATENT NO. : 7,052,338 B2
APPLICATION NO. : 10/213829
DATED : May 30, 2006
INVENTOR(S) : Robert A. Morvillo It is certified that error appears in the above-identified patent and that said Letters Patent is hereby corrected as shown below:

Col.22, line 23
In claim 12, change claim 1 to claim 11.

Signed and Sealed this

Thirty-first Day of October, 2006

JON W. DUDAS
*Director of the United States Patent and Trademark Office*